US010918252B2

(12) United States Patent
Suvarna et al.

(10) Patent No.: US 10,918,252 B2
(45) Date of Patent: Feb. 16, 2021

(54) DIRT DETECTION LAYER AND LASER BACKSCATTER DIRT DETECTION

(71) Applicant: Neato Robotics, Inc., Newark, CA (US)

(72) Inventors: Sarath Kumar Suvarna, Fremont, CA (US); Rachel Lucas, Hayward, CA (US); Kingman Yee, San Jose, CA (US); Thomas Bonia, Belmont, CA (US)

(73) Assignee: Neato Robotics, Inc., Newark, CA (US)

( * ) Notice: Subject to any disclaimer, the term of this patent is extended or adjusted under 35 U.S.C. 154(b) by 160 days.

(21) Appl. No.: 16/040,449

(22) Filed: Jul. 19, 2018

(65) Prior Publication Data

US 2019/0029486 A1 Jan. 31, 2019

Related U.S. Application Data

(60) Provisional application No. 62/537,907, filed on Jul. 27, 2017.

(51) Int. Cl.
*A47L 9/28* (2006.01)
*A47L 11/40* (2006.01)

(52) U.S. Cl.
CPC ..... *A47L 9/2815* (2013.01); *A47L 9/2826* (2013.01); *A47L 9/2831* (2013.01); *A47L 9/2842* (2013.01);
(Continued)

(58) Field of Classification Search
CPC ..... A47L 11/4011; A47L 11/4061; A47L 2201/04; A47L 2201/06; A47L 9/2826;
(Continued)

(56) References Cited

U.S. PATENT DOCUMENTS 4,601,082 A * 7/1986 Kurz ..... A47L 9/2815 15/319
5,109,566 A * 5/1992 Kobayashi ..... A47L 11/4011 15/319
(Continued)

FOREIGN PATENT DOCUMENTS

DE 102007010979 B3 5/2008
DE 102007036170 A1 * 2/2009 ..... A47L 9/2815
(Continued)

OTHER PUBLICATIONS

JP 2004243202 A—English Machine Translation (Year: 2004).*
(Continued)

*Primary Examiner* — Marc Carlson
(74) *Attorney, Agent, or Firm* — Kilpatrick Townsend & Stockton LLP

(57) ABSTRACT

This disclosure describes various methods and apparatus for detecting and characterizing debris pickup during a cleaning operation. A debris detection sensor is described capable of counting the number of particles retrieved by a robotic vacuum during the cleaning operation and associating particles identified with particular areas. The location information can be obtained using various sensors on-board the robotic vacuum. In some embodiments, a cleaning operation can be rerouted when senor readings from the debris detection sensor deviate from historical sensor readings by a predetermined amount.

17 Claims, 14 Drawing Sheets

(52) U.S. Cl.
CPC ..... *A47L 9/2852* (2013.01); *A47L 9/2857* (2013.01); *A47L 11/4011* (2013.01); *A47L 11/4061* (2013.01); *A47L 2201/04* (2013.01); *A47L 2201/06* (2013.01)

(58) Field of Classification Search
CPC .... A47L 9/2831; A47L 9/2842; A47L 9/2852; A47L 9/2857; A47L 9/2815
See application file for complete search history.

(56) References Cited

U.S. PATENT DOCUMENTS

| | | | | | |
|---|---|---|---|---|---|
| 5,163,202 | A * | 11/1992 | Kawakami | A47L 9/2815 | 15/319 |
| 5,233,682 | A * | 8/1993 | Abe | A47L 9/2815 | 15/319 |
| 5,251,358 | A * | 10/1993 | Moro | A47L 9/281 | 15/319 |
| 5,319,827 | A * | 6/1994 | Yang | A47L 9/2842 | 15/319 |
| 5,542,146 | A * | 8/1996 | Hoekstra | A47L 9/281 | 15/319 |
| 6,956,348 | B2 | 10/2005 | Landry et al. | | |
| 7,288,912 | B2 | 10/2007 | Landry et al. | | |
| 8,855,914 | B1 * | 10/2014 | Alexander | G05D 1/0219 | 701/400 |
| 8,903,589 | B2 | 12/2014 | Sofman et al. | | |
| 8,996,172 | B2 | 3/2015 | Shah et al. | | |
| 9,414,731 | B2 * | 8/2016 | Soejima | A47L 9/2815 | |
| 2012/0079670 | A1 * | 4/2012 | Yoon | G05D 1/021 | 15/319 |
| 2012/0169497 | A1 * | 7/2012 | Schnittman | B25J 11/0085 | 340/540 |
| 2013/0226344 | A1 * | 8/2013 | Wong | G05D 1/0242 | 700/258 |
| 2016/0000288 | A1 * | 1/2016 | Soejima | A47L 9/2831 | 15/319 |
| 2016/0113469 | A1 * | 4/2016 | Schnittman | A47L 11/4025 | 250/221 |

FOREIGN PATENT DOCUMENTS

| | | | | |
|---|---|---|---|---|
| DE | 102007036170 | A1 | 2/2009 | |
| DE | 102017213431 | A1 * | 2/2019 | A47L 9/2821 |
| EP | 2407074 | A2 * | 1/2012 | A47L 9/2805 |
| EP | 2407074 | B1 | 6/2017 | |
| JP | 2004243202 | A * | 9/2004 | |
| KR | 20110010356 | A | 2/2011 | |
| KR | 20140100351 | A | 8/2014 | |

OTHER PUBLICATIONS

Search Report dated Jan. 29, 2019, issued in GB Application No. 18112247.3, date filed Jul. 21, 2018, 5 pages.
First Office Action dated Aug. 15, 2019, issued in CA Application No. 3,012,5273, date filed Jul. 26, 2018, 3 pages.

* cited by examiner

A-A

DIRT DETECTION LAYER AND LASER BACKSCATTER DIRT DETECTION

CROSS REFERENCE TO RELATED APPLICATIONS

This application claims priority to U.S. Provisional Patent Application 62/537,907, entitled "Dirt Detection Layer and Laser Backscatter Dirt Detection", filed Jul. 27, 2017, which is incorporated herein in its entirety and for all purposes.

BACKGROUND

Various dust detectors have been proposed for vacuum cleaners, such as using optical detectors and photointerrupters and modifying the blower speed based on the amount of dust detected. Examples are found in U.S. Pat. Nos. 4,601,082, 5,109,566, 5,163,202, 5,233,682, 5,251,358, 5,319,827, 5,542,146, typically using an LED and photodetector. A piezoelectric debris sensor is described in U.S. Pat. No. 6,956,348. Adjusting the blower speed based on debris detection can result in the blower lagging behind the sensor so that the cleaner has passed over the dirty area before a higher blower speed is activated. A debris detection sensor capable of more accurately detecting debris and providing actionable information to a control system is desirable.

SUMMARY OF THE INVENTION

This disclosure describes various embodiments that relate to methods and apparatus for detecting and characterizing the amount of debris entering a robotic vacuum.

The robotic vacuum can include a debris detection system arranged along a conduit of the robotic vacuum through which debris flows before being collected in a receptacle for later disposal. The debris detection system can be a light-based system that operates by emitting light across the conduit. Light sensors, which are also positioned within the conduit are configured to detect portions of the light that are scattered by debris particles passing through the conduit. The debris detection system can also include a beam stop sensor that is configured to receive portions of the light that are not scattered by dust particles. The beam stop sensor can be positioned outside the conduit, which allows the beam stop sensor to be exposed to substantially less dust than the other light sensors. By measuring the amount of light exiting the conduit, a scaling factor can be calculated to determine how severely the light sensors are being occluded by dust build-up.

In some embodiments, numerous light emitters can be incorporated into a debris detection system, allowing other parameters such as debris particle speed and average particle size to be determined during normal cleaning operations. In some embodiments, the light emitters can take the form of lasers, while the light sensors can take the form of high speed light sensors capable of making thousands of readings per second, thereby allowing accurate tracking of the number of particles passing through the conduit.

Readings from the debris detection system can be used to track the buildup of debris throughout any areas that are regularly cleaned by the robotic vacuum. By analyzing the historical debris detection system readings, debris build up patterns can be anticipated allowing the routing of the robotic vacuum to be targeted to cover more thoroughly those areas most likely to contain the most debris. Furthermore, settings of the vacuum can be adjusted during different portions of the routing in order to more effectively retrieve debris from the floor. In some embodiments, the robotic vacuum can be configured to periodically update the routing when a difference between readings from the debris detection sensor and the anticipated readings based on historical data exceed a predetermined threshold.

Additional advantages of the invention include being able to plan a quick route that only cleans the areas with the heaviest debris (an emergency "company is coming, make it look pretty quickly" run), or a route planned with energy efficiency in mind, that picks up the most amount of debris when the robot has a limited charge left. In some instances, the robot may be able to determine the size of the particles, and may plan a route to cover more thoroughly clean areas with higher density of certain particle sizes (such as larger particles, as they're more visible to guests, or very small particles, which can be allergens such as pet dander or pollen).

A robotic cleaning device is disclosed and includes the following: a housing having walls defining a conduit extending from an air intake to a receptacle for retaining particles drawn through the conduit; a suction system for drawing air through the intake, along the conduit and into the receptacle; a light emitter configured to emit light across the conduit and out of the conduit through an opening defined by the one of the walls of the housing; and a light detector proximate the light emitter and coupled to a portion of one of the walls defining the conduit, the light detector being configured to detect a portion of the light that is scattered by particles being drawn through the conduit; and a processor configured to receive sensor data from the light detector and to determine how many particles are passing through the conduit based on variations in the amount of the portion of the light incident on the light detector.

A method for routing a robotic vacuum is disclosed and includes the following: generating a cleaning route for the robotic vacuum based at least in part upon an expected debris intake; initiating the cleaning route; recording debris intake data using an on-board debris detection sensor while performing the cleaning route; periodically comparing the recorded debris intake data to the expected debris intake; and updating the cleaning route using at least a portion of the recorded debris intake data in response to the comparing indicating a difference between the recorded debris intake data and the expected debris intake exceeding a predetermined threshold.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
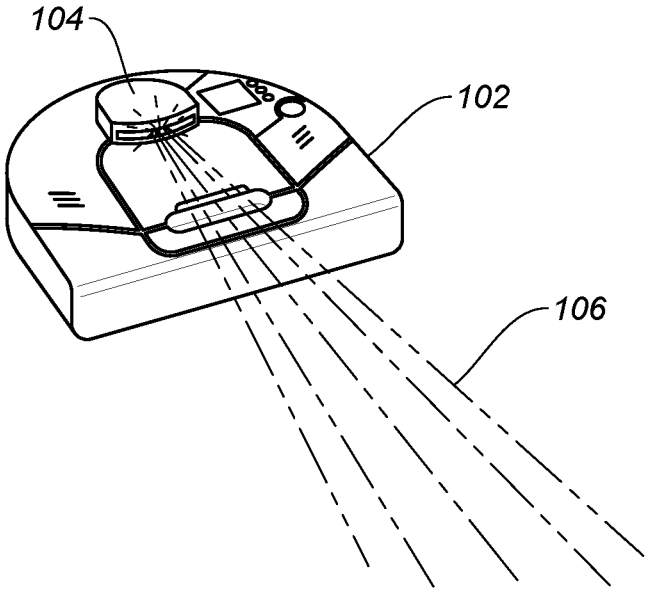
FIG. 1 is a diagram of a robotic cleaning device with a LIDAR turret.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

Robotic cleaning devices generally run off battery power and as such may not be able to operate at peak cleaning power throughout a cleaning operation that covers an entire residence or cleaning area. For this reason, it may be advisable to modulate the settings of the robotic vacuum power and/or adjust the routing of the robotic vacuum to improve performance. This variation in performance and routing can be quite helpful as debris build-up can be highly varied in any given cleaning area. For example, there may be much greater debris build up in a dining room and entry way than in a seldom-used storage room or closet. For this reason, the robotic vacuum should be able to shift its efforts more heavily toward cleaning the areas of greatest debris build up than trying to cover areas that have negligible or very gradual debris build up.

Unfortunately, since every residence is different, it can be quite difficult for a robotic vacuum to identify or predict areas of greater debris build up. For example, an imaging device mounted to an exterior surface of the device would generally not have sufficient resolving power to spot the small particles spread around the floor of a residence. One solution to this problem is to position a debris sensing assembly within a conduit through which debris sucked into the robotic vacuum passes. The debris sensing assembly can include a sensor configured to measure the number of particles drawn into the robotic vacuum by emitting light across the conduit and then measuring how that light is scattered by the debris passing through the conduit using one or more optical sensors. This sensor data can then be correlated to the current position of the robotic vacuum as the particles are detected. In some embodiments, a debris detection sensor can, in addition to measuring the number of particles, further characterize the debris collected by estimating a size of each particle.

This location-based particle collection data can then be collected over a span of multiple cleaning operations to identify trends indicative of where dirt and debris are most likely and most frequently likely to be deposited. Routing of the robotic vacuum can be optimized to cover areas most likely to be have higher concentrations of debris. In order to deal with the higher debris concentrations, the robotic vacuum can be configured to make multiple passes and/or reconfigure its settings to increase the amount of debris sucked into the robotic vacuum on each pass when traversing areas of higher expected debris density. For example, blower speed and/or vacuum movement speed can be adjusted. In some embodiments, cleaning routing can be changed in the middle of a cleaning operation if the debris detection sensor identifies the debris as being too much different from expected levels.

These and other embodiments are discussed below with reference to FIGS. 1-14; however, those skilled in the art will readily appreciate that the detailed description given herein with respect to these figures is for explanatory purposes only and should not be construed as limiting.

A. Overall Architecture

FIG. 1 is a diagram of a robotic cleaning device with a LIDAR turret. A robotic cleaning device 102 can include a LIDAR (Light Detection and Ranging) turret 104, which can emit a rotating laser beam 106. Detected reflections of the laser beam off objects can be used to calculate both the distance to objects and the location of the robotic cleaning device 102. One embodiment of the distance calculation is set forth in U.S. Pat. No. 8,996,172, "Distance sensor system and method," the disclosure of which is incorporated herein by reference. The collected data is also used to create a map, using a Simultaneous Location and Mapping (SLAM) algorithm. One embodiment of a SLAM algorithm is described in U.S. Pat. No. 8,903,589, "Method and apparatus for simultaneous localization and mapping of mobile robot environment," the disclosure of which is incorporated herein by reference. Alternately, other methods of localization could be used, such as Video Simultaneous Localization And Mapping (VSLAM), which utilizes inputs from a video camera and image processing for determining or helping to determine a location of the robotic cleaning device. Additional sensors useful for characterizing an environment around the robot include infrared and ultrasonic sensors, which can be used to characterize or assist in characterizing a surrounding environment.

Figure 2:
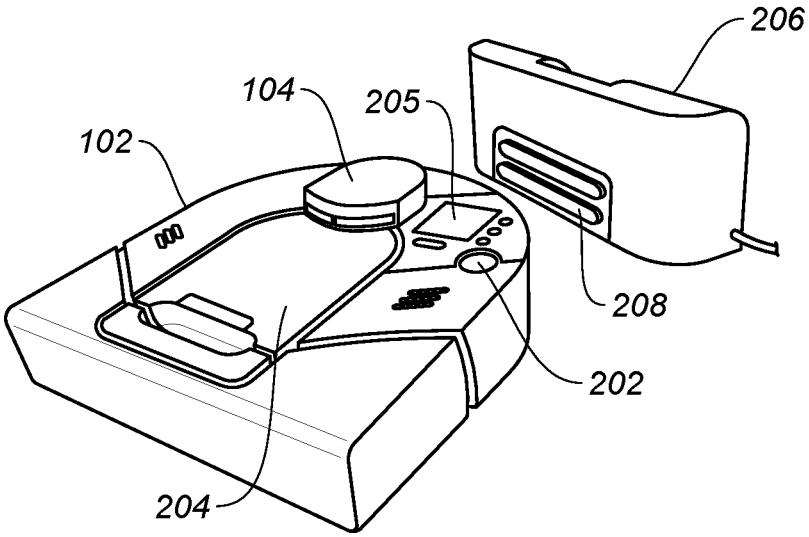
FIG. 2 is a diagram of a robotic cleaning device and charging station.

FIG. 2 is a diagram of a robotic cleaning device and charging station. The robotic cleaning device 102 with the turret 104 of FIG. 1 is shown. Also shown is a cover 204, which can be opened to access a dirt collection bag and the top side of a brush. Buttons 202 can allow basic operations of the robotic cleaning device 102, such as starting a cleaning operation. A display 205 can provide information to the user. The robotic cleaning device 102 can dock with a charging station 206, and receive electricity through charging contacts 208.

Figure 3:
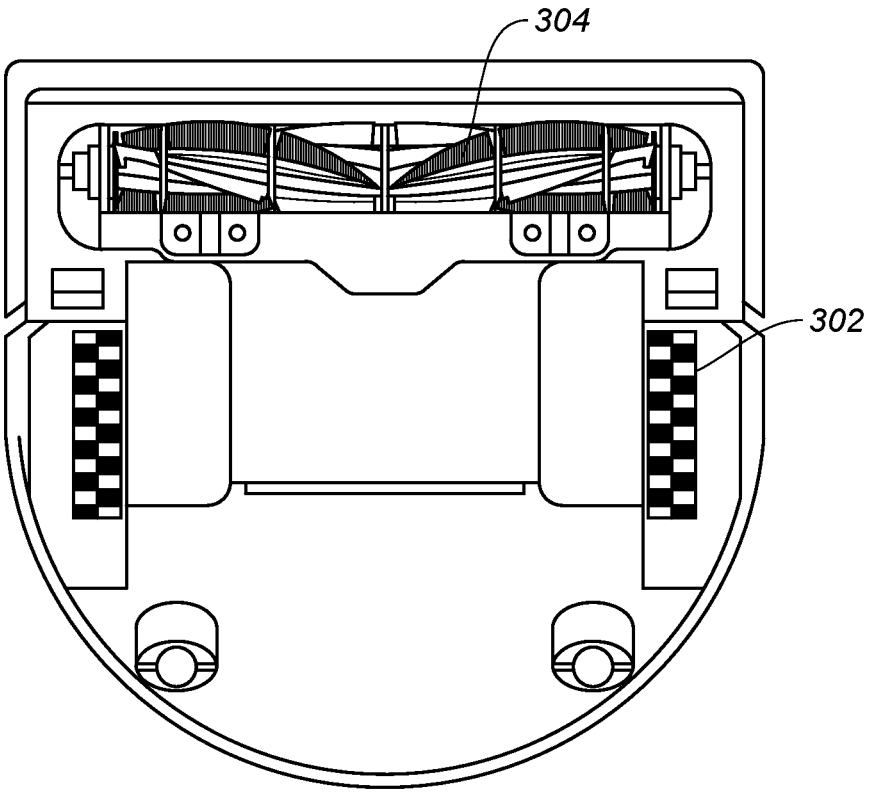
FIG. 3 is a diagram of the underside of a robotic cleaning device.

FIG. 3 is a diagram of the underside of a robotic cleaning device. Wheels 302 can move the robotic cleaning device, and a brush 304 can help free dirt to be vacuumed into the dirt bag. In some embodiments, wheels 302 can include a suspension allowing a rear portion of a housing of the robotic cleaning device to be lifted up in order to change a tilt angle of the robotic cleaning device during or prior to a cleaning operation.

Figure 4:
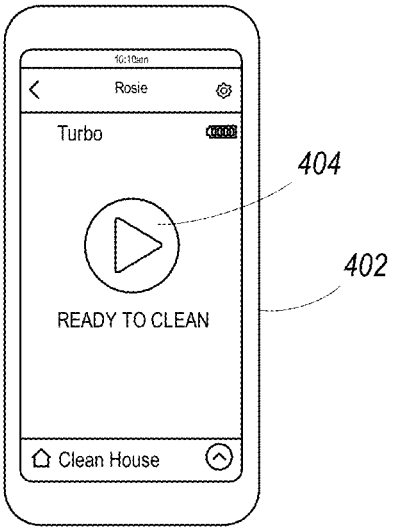
FIG. 4 is a diagram of a smartphone control application display for a robotic cleaning device.

FIG. 4 is a diagram of a smartphone control application display for a robotic cleaning device. A smartphone 402 has an application that is downloaded to control the robotic cleaning device. An easy to use interface can include a start button 404 to initiate cleaning.

Figure 5:
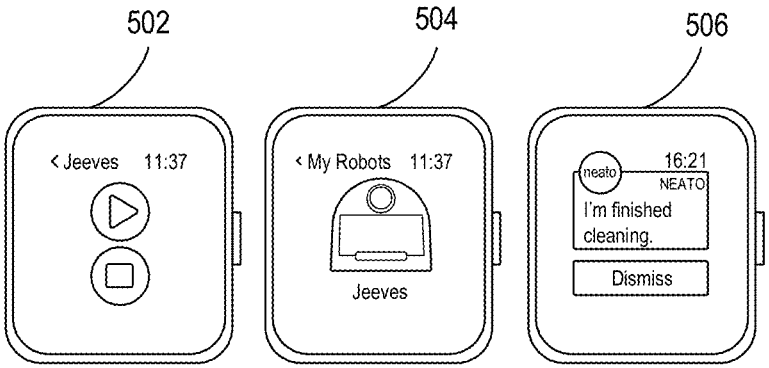
FIG. 5 is a diagram of a smart watch control application display for a robotic cleaning device.

FIG. 5 is a diagram of a smart watch control application display for a robotic cleaning device. Example displays are shown. A display 502 provides and easy to use start button. A display 504 provides the ability to control multiple robotic cleaning devices. A display 506 provides feedback to the user, such as a message that the robotic cleaning device has finished.

Figure 6:
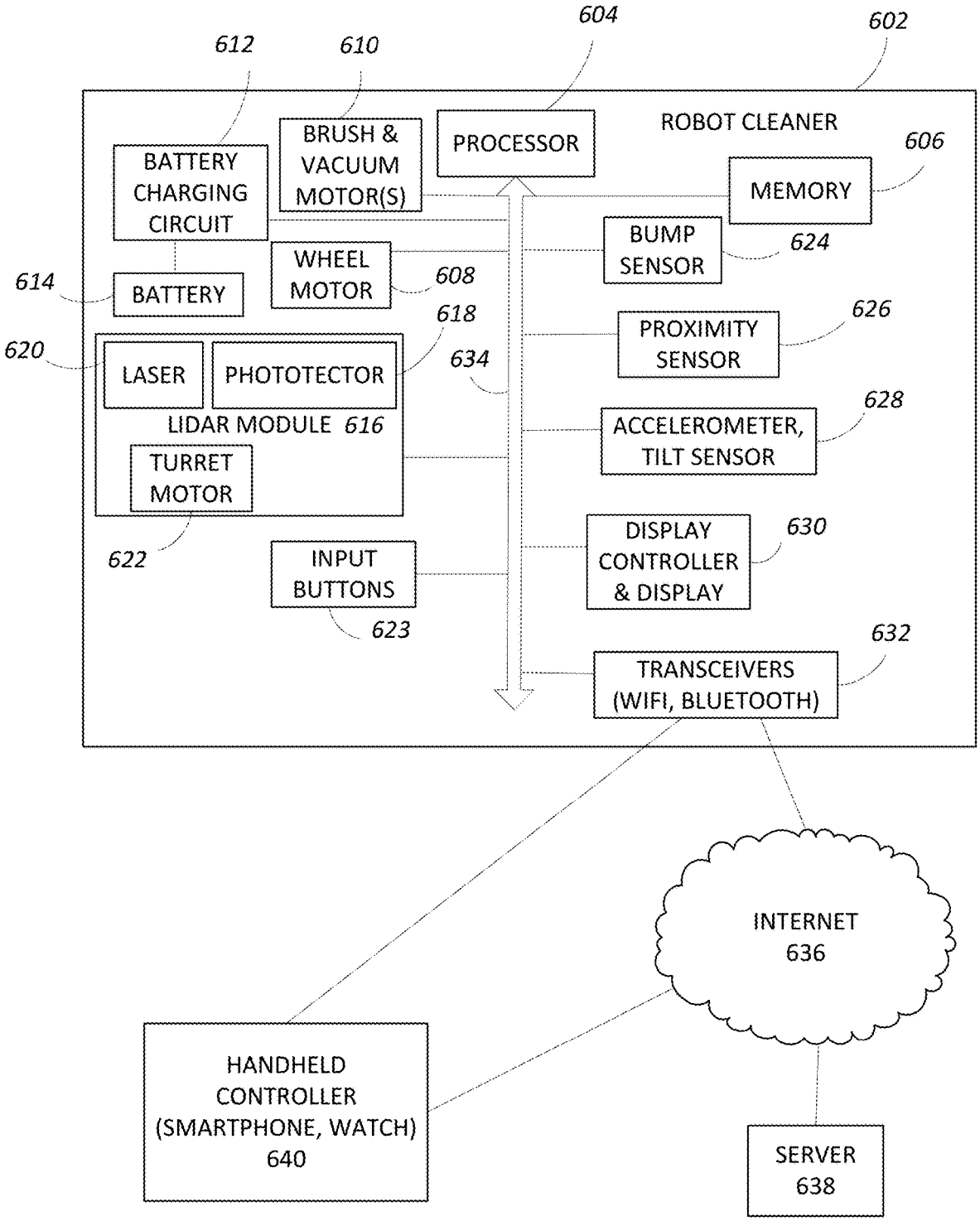
FIG. 6 is a diagram of an electronic system for a robotic cleaning device.

FIG. 6 is a high level diagram of an electronic system for a robotic cleaning device. A robotic cleaning device 602 includes a processor 604 that operates a program downloaded to memory 606. The processor communicates with other components using a bus 634 or other electrical connections. In a cleaning mode, wheel motors 608 control the wheels independently to move and steer the robot. Brush and vacuum motors 610 clean the surface, and can be operated in different modes, such as a higher power intensive cleaning mode or a normal power mode.

LIDAR module 616 includes a laser 620 and a detector 616. A turret motor 622 moves the laser and detector to detect objects up to 360 degrees around the robotic cleaning device. There are multiple rotations per second, such as about 5 rotations per second. Various sensors provide inputs to processor 604, such as a bump sensor 624 indicating contact with an object, proximity sensor 626 indicating closeness to an object, and accelerometer and tilt sensors 628, which indicate a drop-off (e.g., stairs) or a tilting of the robotic cleaning device (e.g., upon climbing over an obstacle). Examples of the usage of such sensors for navigation and other controls of the robotic cleaning device are set forth in U.S. Pat. No. 8,855,914, "Method and apparatus for traversing corners of a floored area with a robotic surface treatment apparatus," the disclosure of which is incorporated herein by reference. Other sensors may be included in other embodiments, such as a dirt sensor for detecting the amount of dirt being vacuumed, a motor current sensor for detecting when the motor is overloaded, such as due to being entangled in something, a surface sensor for detecting the type of surface, and an image sensor (camera) for providing images of the environment and objects.

A battery 614 provides power to the rest of the electronics through power connections (not shown). A battery charging circuit 612 provides charging current to battery 614 when the robotic cleaning device 602 is docked with charging station 206 of FIG. 2. Input buttons 623 allow control of the robotic cleaning device 602 directly, in conjunction with a display 630. Alternately, the robotic cleaning device 602 may be controlled remotely, and send data to remote locations, through transceivers 632.

Through the Internet 636, and/or other network(s), the robotic cleaning device 602 can be controlled, and can send information back to a remote user. A remote server 638 can provide commands, and can process data uploaded from the robotic cleaning device 602. A handheld smartphone or watch 640 can be operated by a user to send commands either directly to the robotic cleaning device 602 (through Bluetooth, direct RF, a WiFi LAN, etc.) or can send commands through a connection to the internet 636. The commands could be sent to server 638 for further processing, then forwarded in modified form to the robotic cleaning device 602 over the internet 636.

B. Light Scatter-Based Particle Detection

Figure 7A:
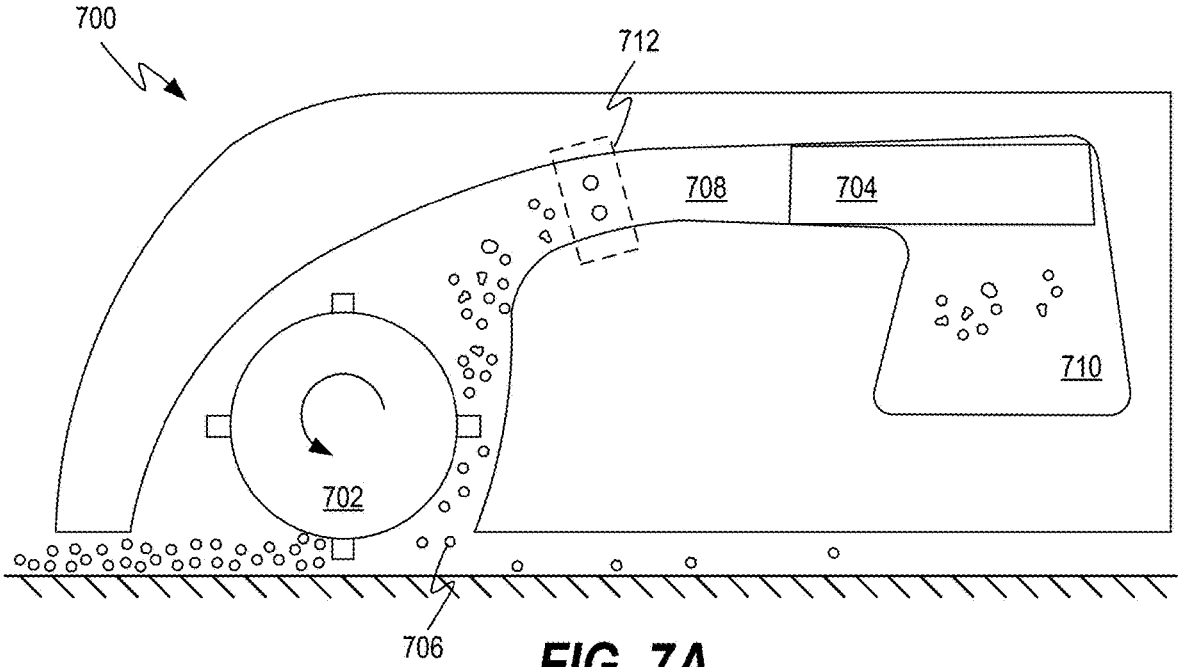
FIGS. 7A-7B show cross-sectional views of conduits of various suction systems.

FIG. 7A shows a cross-sectional view of a suction-based system taking the form of a robotic vacuum 700 configured to remove debris and dirt from flooring. Robotic vacuum 700 includes a brush 702 and a suction system 704 configured to draw dirt and other types of debris particles 706 into and through a conduit 708 and then into a receptacle 710. A position and speed of brush 702 can be adjusted to increase or decrease cleaning performance of robotic vacuum 700. Robotic vacuum 700 can also include a debris sensing assembly 712, which can be positioned within a narrow region of conduit 704. Debris sensing assembly 712 can be configured to detect the passage of debris particles 706 by emitting light and detecting the light scattered by debris particles 706 as they travel through conduit 708.

Figure 7B:
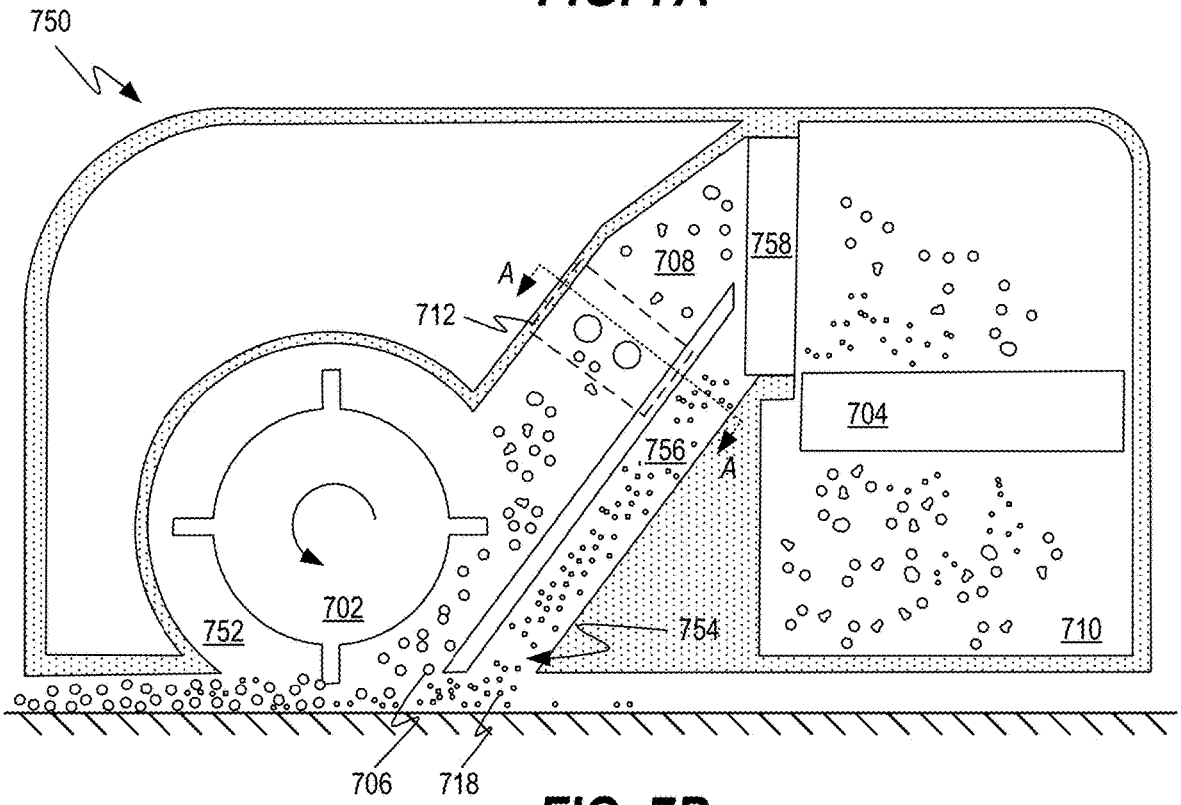

FIG. 7B shows a cross-sectional view of another suction-based system taking the form of a robotic vacuum 750 configured to remove debris and dirt from flooring. Vacuum 750 includes two throats with corresponding intakes for retrieving debris from the flooring. Primary intake 752 extends across a majority of a width of robotic vacuum 750 and includes roller 702. Secondary intake 754 has about the same width as primary intake 752 but is much shorter making a size of intake 754 about two or three times smaller than primary intake 752. The smaller size of secondary intake 754 results in a greater amount of suction being generated at secondary intake 754 than at primary intake 752. An overall amount of suction being generated by suction system 704 can be reduced as the smaller intake size of intake 754 allows for a higher effective negative pressure to be achieved at intake 754. In this way, larger particles 706, which require less suction to be drawn into vacuum 750, are drawn into primary intake 752, leaving the harder to retrieve smaller particles 718 on the flooring. Smaller particles 718 are instead drawn into secondary intake 754 by the greater amount of suction at secondary intake 754. While debris sensing system 712 is only shown monitoring first conduit 708, another debris sensing system can be positioned within second conduit 756 associated with secondary intake 754 in order to measure a total amount of input into vacuum 750. By dividing the debris in accordance with its size, debris sensing system 712 can be optimized for detection of larger or smaller particle size. In some embodiments, the absence of small particles can reduce sensor noise generated by the passage of small particles 754 through debris sensing assembly 712, thereby increasing the accuracy of debris sensing system 712. Robotic vacuum 750 can also include replaceable filter 758, which is configured to block particularly large particles that might do damage to or reduce performance of suction system 704.

Figure 7C:
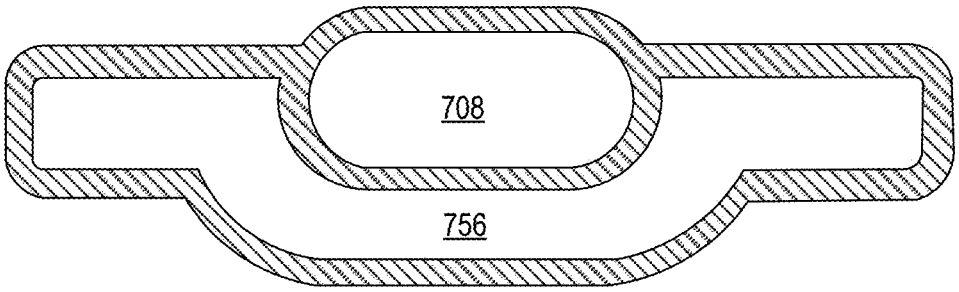
FIG. 7C shows a cross-sectional view of the robotic vacuum embodiment shown in FIG. 7B in accordance with section line A-A of FIG. 7B.

FIG. 7C shows a cross-section of robotic vacuum 750 in accordance with section line A-A of FIG. 7B. In particular, a cross-sectional area of conduit 708 is substantially smaller than intake 752 while a size or total cross-sectional area of conduit 756 is substantially larger than intake 754. In some embodiments, a size of the portion of conduits 708 and 756 can be about the same size. This results in conduit 708 expanding in size as it extends toward the flooring and conduit 756 narrowing in size as it nears the flooring. By using tapered conduits in this manner the effective suction at intakes 752 and 754 can be further differentiated.

Figure 8A:
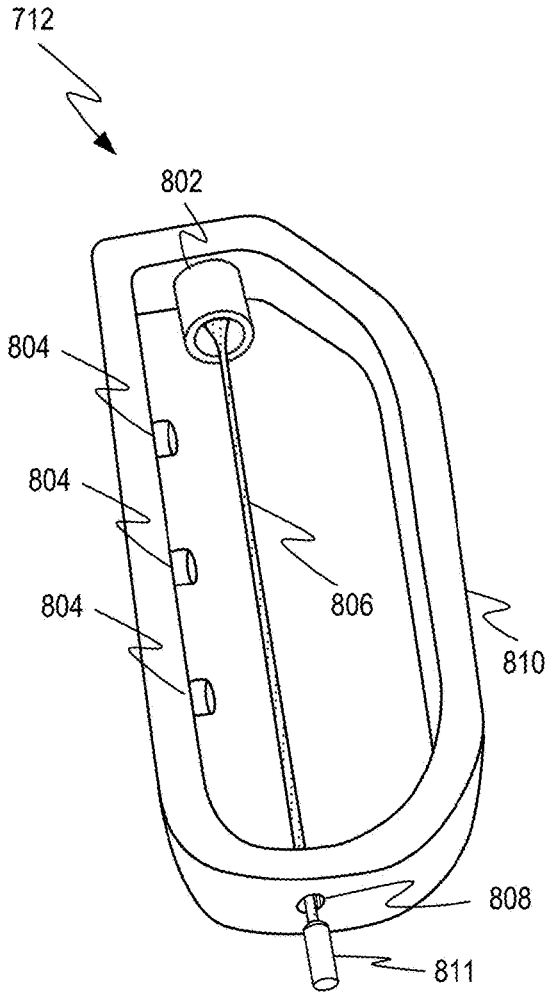
FIGS. 8A-8D show perspective views of various configurations of debris sensing assembly.

FIGS. 8A-8D show perspective views of various configurations of debris sensing assembly 712. In particular, FIG. 8A shows how debris sensing assembly 712 can include a collimated light source 802 and sensors 804 offset from collimated light source 802. In some embodiments, light source 802 can take the form of a laser having a wavelength of about 650 nm. Alternatively, light source 802 can also take the form of a light emitting diode coupled with collimating optics. While three sensors 804 are depicted it should be appreciated that debris sensing assembly 712 can include any number of sensors including just a single sensor. Each of the one or more sensors 804 can be configured to detect light scattered off dirt or debris particles 706 passing through debris sensing assembly 712. In some embodiments, sensors 804 can take the form of photodiodes having a wavelength detection range in accordance with the wavelength of light generated by light source 802. It should be noted that the size of debris particles 706 are enlarged out of scale for exemplary purposes only. In some embodiments, interior-facing surfaces of the walls defining the conduit proximate collimated light source 802 can have light absorbing properties that attenuate any reflection of light off the walls defining conduit 708. For example, the walls defining conduit 708 can have a dark color and/or the surface of the conduit could be roughened to further diffuse any reflected light. Reducing the amount of reflected light in this manner can reduce the likelihood of sensors 804 inaccurately characterizing particles 706 passing through conduit 708 due to any multi-bounce phenomenon.

Debris sensing assembly 712 can also include various calibration and error-checking mechanisms to help provide accurate data. In some embodiments, readings from the different sensors can be averaged or compared to help gauge the accuracy of the data being retrieved. For example, in some embodiments, where one of sensors 804 is giving substantially different data than the other sensors 804, data from that sensor could be ignored. In some embodiments, when no particles 706 are actively disrupting light beam 806, light beam 806 can pass entirely through an opening 808 in the side of a wall 810 defining the conduit associated with debris sensing assembly 708. In this way, when no particles are disrupting light beam 806 the likelihood of any of the light inadvertently reflecting off a surface back in to one of sensors 804 is substantially lowered. Another way of monitoring debris build up on sensors 804, is for the vacuum to take sensor readings prior to every operation of the vacuum. The light illuminator can be activated and then any light detected can be subtracted out from readings taken during normal vacuum operation. In this way, any scattering of light caused by accumulated dust within the conduit can be accounted for prior to initiation of normal operation. In some embodiments, when dust accumulation exceeds a predetermined threshold value a user can be asked to carry out a cleaning operation to bring the sensor assembly back to peak operating efficiency.

In some embodiments, a beam stop sensor 811 can be positioned outside of opening 808. By positioning beam stop sensor 811 outside wall 810, the likelihood of reflections off beam stop sensor 811 and the structure it is mounted on is reduced, reducing false readings by sensors 804. Beam stop sensor 811 can be configured to measure how much light passes through opening 808. This value can be used to help scale readings made by sensors 804. For example, after debris sensing assembly 712 is in operation for a long duration of time, dust can collect and obscure readings made by sensors 804. Beam stop sensor 811, which is positioned outside of the flow of debris 706 can stay much cleaner and be used as a reference value to evaluate the amount of light being lost due to sensor occlusion. Beam stop sensor 811 could also be useful in alerting a user when the debris sensing assembly is in need of cleaning. Eq(1) shows an equation that can be used to create a scaling factor for use with the values received by sensors 804.

$$\text{scaled Sensor} = (\text{measured Sensor})\frac{\text{Initial } beamstop}{\text{Final } beamstop} \qquad \text{Eq (1)}$$

Figure 8B:
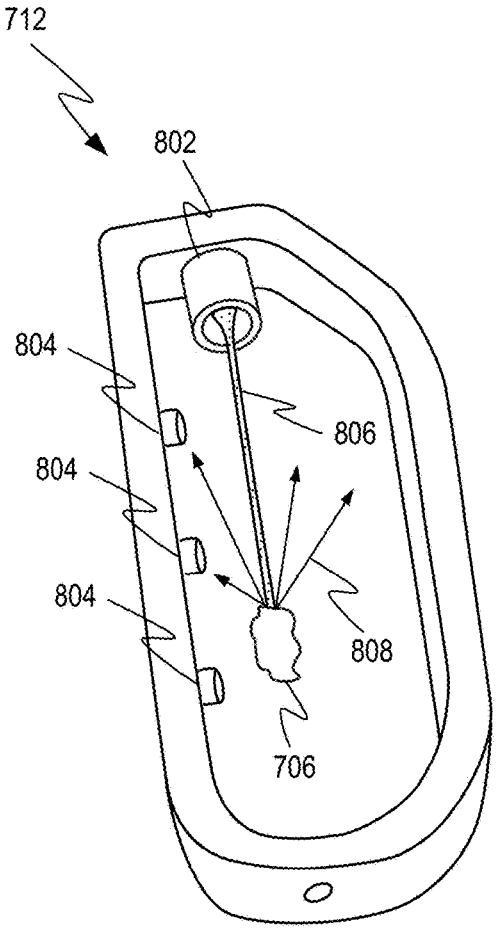

FIG. 8B shows how light beam 806 can scatter off particle 706 as particle 706 passes through light beam 806. Scattered light 808 can be detected by one or more of sensors 804. A processor recording sensor information gathered from sensors 804 can be configured to determine that a particle has passed through debris sensing zone 706 when scattered light 808 is detected by one or more of sensors 804. In some embodiments, a threshold number of detections by the sensors can be required to confirm passage of a particle 706. A rate at which data from the sensors 804 is recorded can be adjusted based on a predicted speed at which particle pass through debris sensing assembly 712. For example, 5000 to 10000 sensor readings can be recorded per second. Taking this number of readings per second can help the processor distinguish the number of particles 706 passing through debris sensing assembly at any particular point in time. In some embodiments, the sensor output can be analog and sensor readings may only be sent to a controller for further processing when the sensor output exceeds a predetermined threshold indicative of the passage of one or more particles.

Figure 8C:
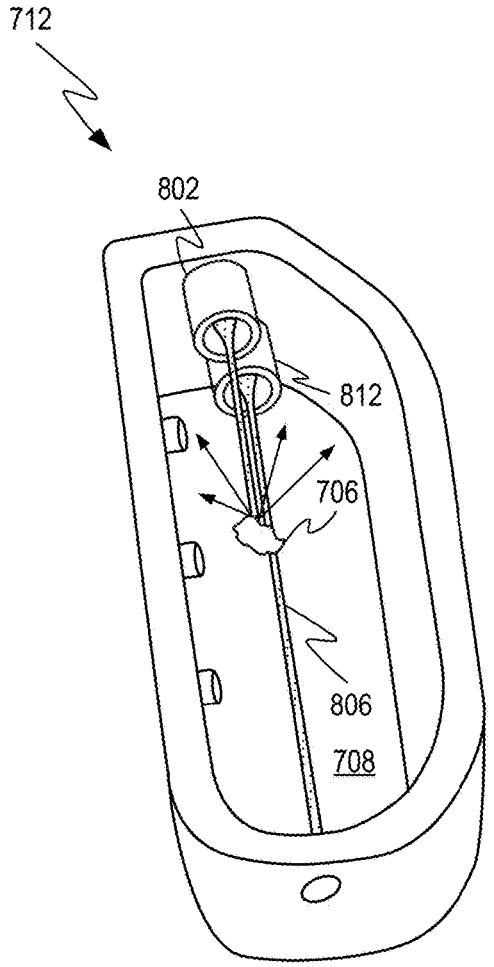

FIG. 8C shows how multiple light sources can extend across conduit 708. By extending multiple light sources across conduit 708, many or in some cases most of particles 706 passing through debris sensing assembly 712 can pass through multiple light beams 806. Light sources 802 and 812 can emit light beams 806 with different characteristics. For example, light beams 806 could have different wavelengths. Alternatively, the light beams could be modulated in a recognizable pattern. When a processor in communication with sensors 804 identifies particle 706 has passed through both light beams 806 a particle size estimation can be performed. In this way, both the number and size of particles passing through debris sensing assembly 712 can be determined or at least estimated with a reasonable degree of confidence. It should be noted that where a large number of particles are expected to pass through debris sensing assembly without contacting any of light beams 806 that software can be configured to estimate the number of particles passing through the conduit based on empirical data. For example, a normalization factor can be applied. The ratio of the beam area to the port cross-sectional area can be used to statistically determine the number of particles passing through the port. A small beam relative to a larger port will require a larger scale factor compared to the case where the beam nearly fills the port.

Figure 8D:
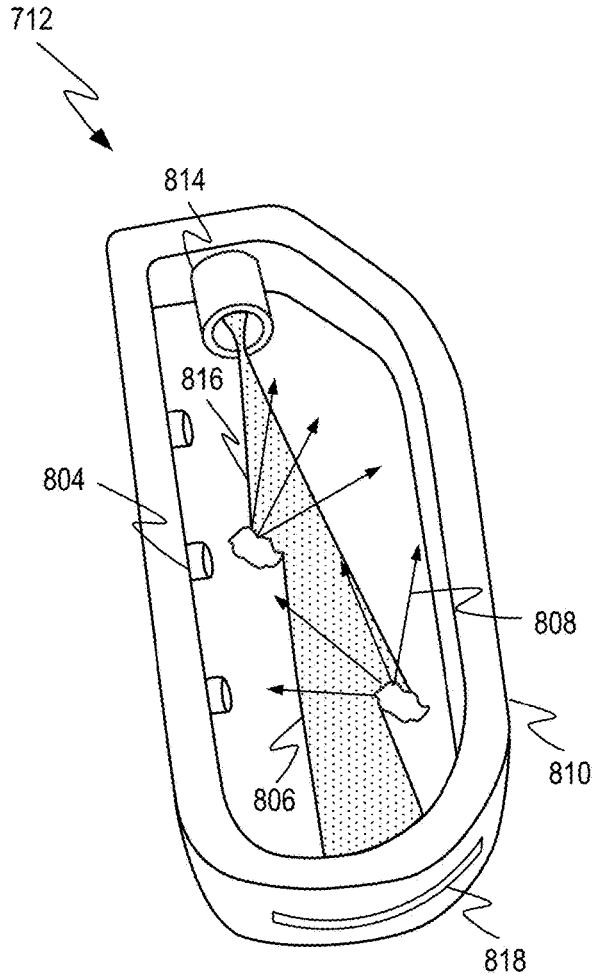

FIG. 8D shows a light source 814 equipped with a line scanner. The line scanner can take the form of optics that change the shape of the light being emitted into a flat line instead of a narrower circular point. The optics can be adapted so that the light spreads across a larger region of conduit 708, as depicted, thereby reducing the likelihood of a particle passing through the light without being detected. The width of light beam 816 can be tuned so that light doesn't shine directly on any of sensors 804. Furthermore, an opening 818 can match the height and width of light beam 816 when light beam 816 is not being disturbed by particles 706, thereby preventing any reflection or scattering of light beam 816 other than when particles pass through light beam 816. It should be noted that light source 814 with its line scanning optics could also be implemented in a dual light source configuration similar to the configuration depicted in FIG. 8C, thereby allowing improved conduit coverage and/or particle size determination.

Figure 9:
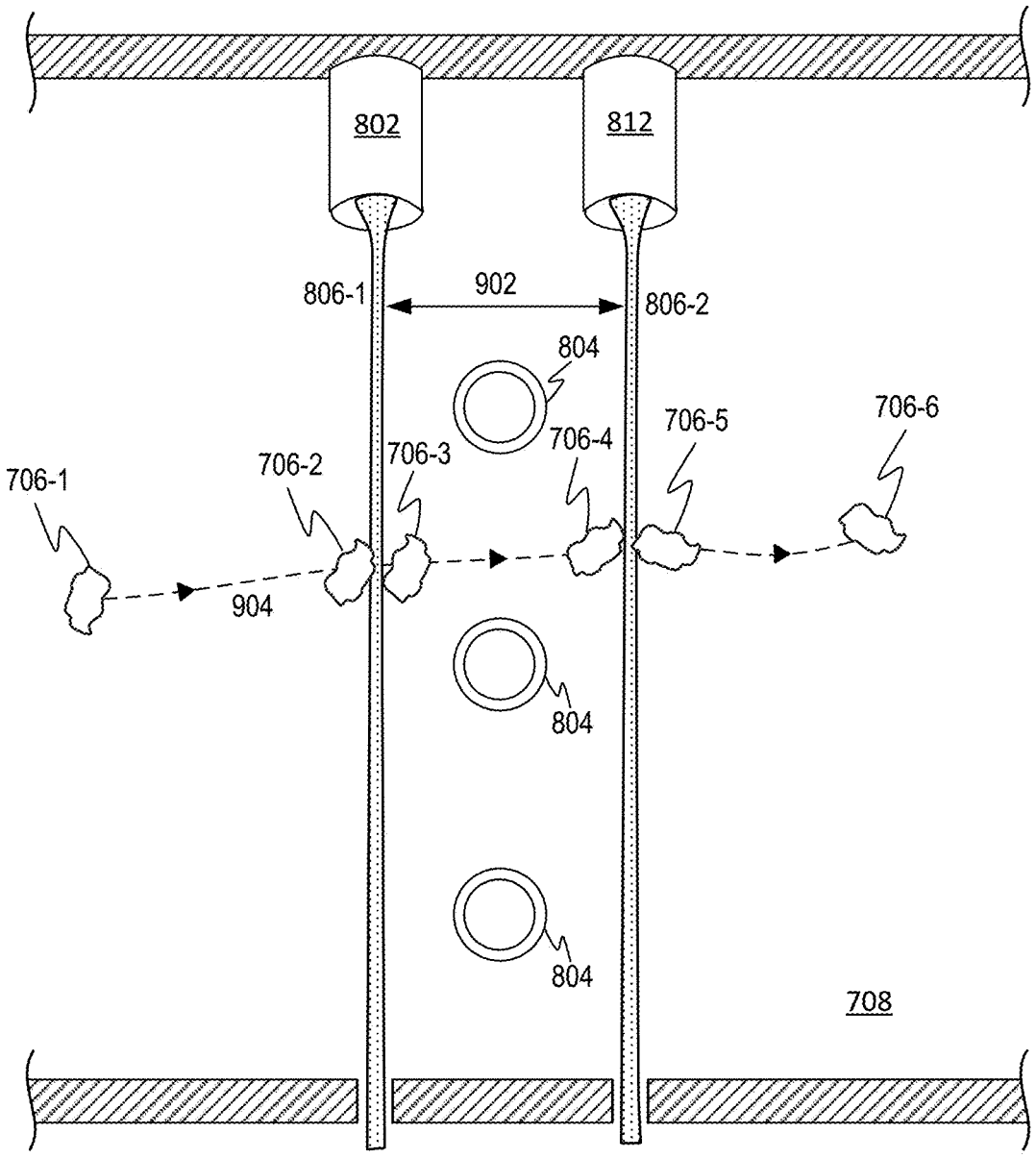
FIG. 9 shows a top view of a conduit corresponding to the configuration depicted in FIG. 8C.

FIG. 9 shows a top view of conduit 708 corresponding to the configuration depicted in FIG. 8C. FIG. 9 shows how light beam 806-2 can be downstream of light beam 806-1 and separated by a distance 902. FIG. 9 also shows a path 904 along which a particle 706 traverses. When particle 706 arrives at position 706-2, light from light beam 806-1 begins to scatter and at least a portion of the scattered light is received at sensors 804. Once particle 706 reaches position 706-3, light from light beam 806-1 is no longer scattered and sensors 804 no longer receive any scattered light. A processor in communication with sensors 804 can then determine the passage of particle 706 along conduit 708. When particle 706 reaches position 706-4 light from light beam 806-2 is scattered and sensors 804 receive more light scattered by particle 706. When light beam 806-1 has a characteristic that is different than the same characteristic of light beam 806-2 and sensors 804 are capable of identifying the difference, the processor can determine that particle 706 is now scattering light from light beam 806-2. Since a distance 902 between light beams 806-1 and 806-2 is known, the elapsed time between when sensors 804 first detected particle 706 at position 706-2 and when sensors 804 first detected particle 706 at position 706-4 allows an average velocity of particle 706 to be determined. By using this velocity, the amount of time for particle 706 to pass through either or both of light beams 806-1 and 806-2 can be used to determine an average diameter of particle 706. In some embodiments, the size determination can be refined by averaging the values calculated from the passage through each light beam. This can help arrive at an average diameter for asymmetric particles like the one depicted in FIG. 9, which may take longer to move through one light beam than another when the orientation of the particle changes from one light beam to another. By positioning sensors 804 between light beams 806-1 and 806-2 any differences in distance between the particle and the sensor can be ameliorated, further reducing the possibility of introducing errors into the diameter calculation. While it should be noted that these calculations can become more difficult when multiple particles are traversing conduit 708 at the same time, the suction generated by the suction system can cause particles passing through conduit 708 to have a predictable velocity. Consequently, when a velocity determination is too far away from an expected value, the velocity determination can be discarded or only counted if confirmed in some other way. For example, a particle velocity could be verified when the duration of the particle within both light beams is particularly close. Other verification methods and particle correlation methods are also possible.

Figure 10:
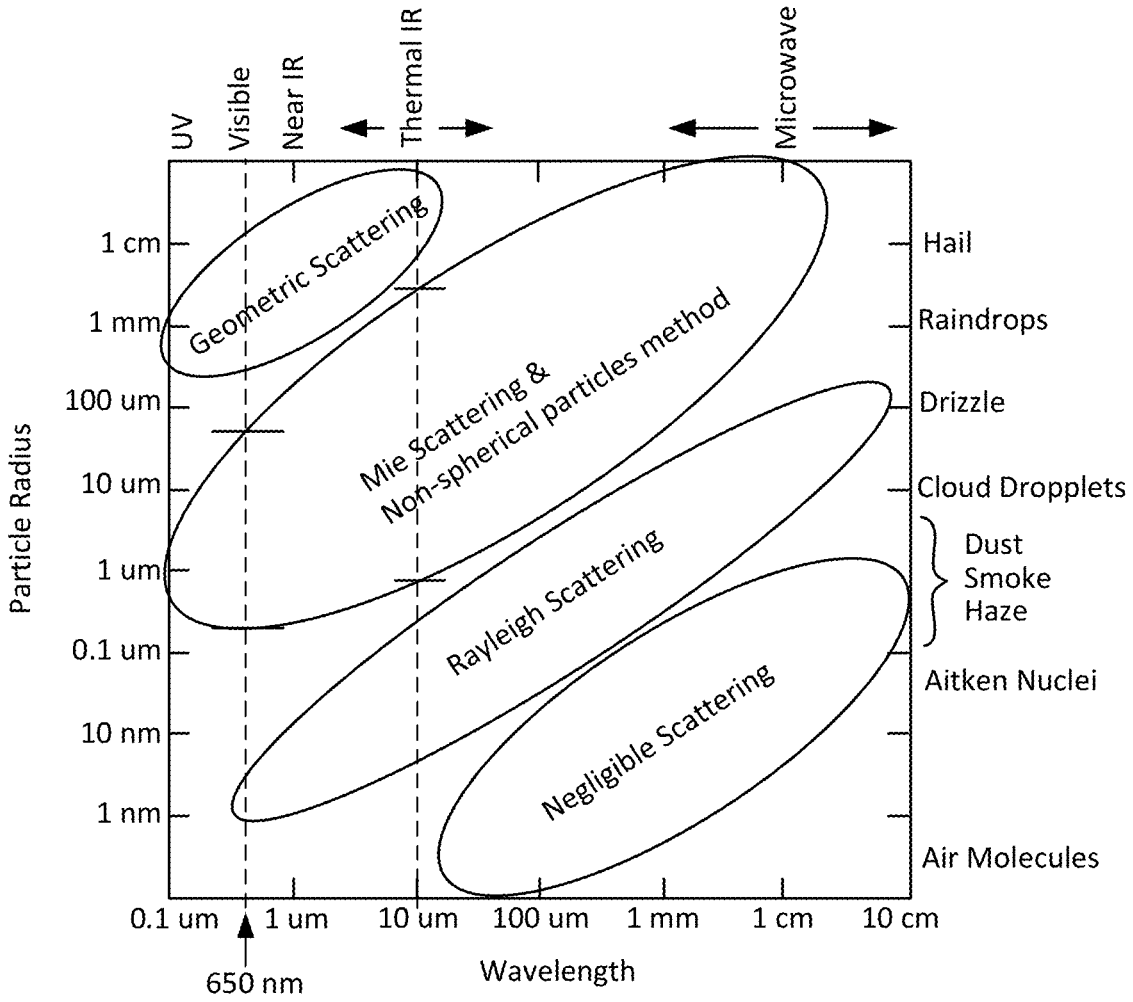
FIG. 10 shows a chart identifying the effectiveness of various models for detecting particles of different size.

FIG. 10 shows a chart identifying the effectiveness of various light scattering models for detecting particles of different size. The Mie Scattering model, for example, is designed to allow a determination of how much light has been scattered by a particle having a size close to the wavelength of the light it scatters. The chart shows how a light source with a wavelength of 650 nm would be able to detect particles with a radius of between 0.5 um and 80 um using the Mie Scattering model. As particles collected by a suction device tend to have a diameter of greater than 1 um, the Mie Scattering model is well configured to detect small particles and capable of detecting particles with a diameter up to about 160 um. In some embodiments, it could be desirable to use an infrared light source allowing larger particle sizes to be detected. For example, a $CO_2$ laser having a wavelength of about 10 um could allow for detection of particles having a diameter of nearly a centimeter and still be capable of detecting particles having diameters smaller than 1 um. Mie scattering calculations are generally performed via computer program and involve infinite series calculations in determining a scattering phase function; however, Eq(2) is a Rayleigh scattering equation, which helps predict the elastic scattering of light by spheres that are much smaller than the wavelength of light, is given as:

$$I = I_0\left(\frac{1+\cos^2\theta}{2R^2}\right)\left(\frac{2\pi}{\lambda}\right)^4\left(\frac{n^2-1}{n^2+2}\right)^2\left(\frac{d}{2}\right)^6 \quad \text{Eq (2)}$$

As indicated by Eq(2), scattering intensity decreases proportionally with the fourth power of wavelength and increases proportionally with the sixth power of particle diameter.

C. Adaptive Routing Using Particle Detection Data

Figure 11:
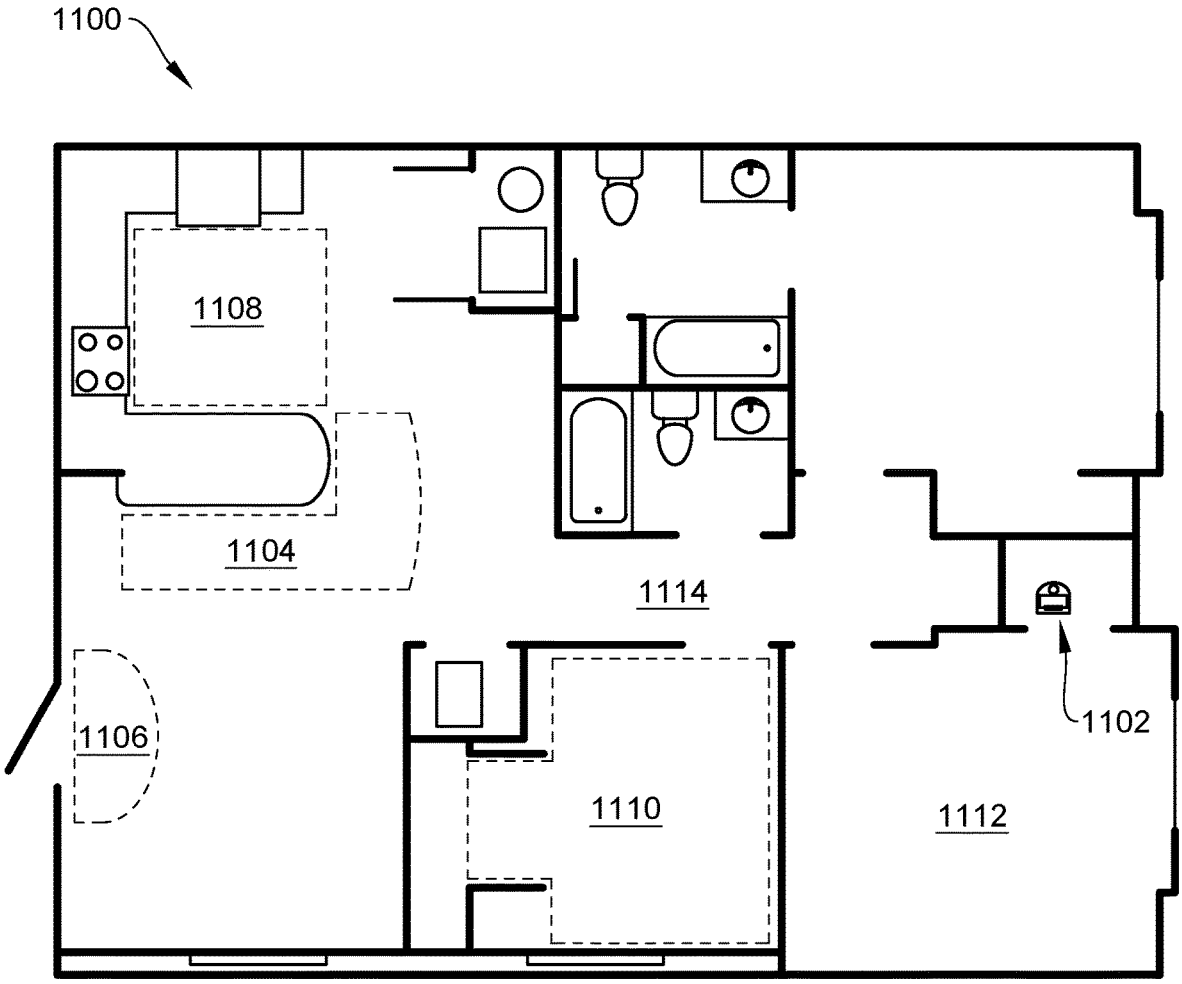
FIG. 11 shows an exemplary residence suitable for use with the described embodiments.

FIG. 11 shows an exemplary residence 1100 suitable for use with the described embodiments. Robotic vacuum 1102 can be configured to periodically clean residence 1100. While robotic vacuum 1102 may be capable of establishing a cleaning pattern that covers substantially all of residence 1100 doing so may not be desirable or efficient. For example, certain areas within residence 1100 may be much more likely to contain accumulated dust and/or debris. By targeting these areas more often than areas less prone to dust accumulation robotic vacuum 1102 can remove dust and debris from residence with greater efficiency and in less time.

Prior to establishing normal pickup operation robotic vacuum 1102 can be configured to first identify the location of various rooms and obstacles. LIDAR turret 104, previously depicted in FIG. 1, can be configured to identify the locations of these rooms and various obstacles within the rooms such as table and furniture. Room identification can also include a determination of what type or frequency of use each room is expected to have. For example, a bedroom 1112 could be expected to have substantially less traffic than a hallway 1114. A hallway could be identified by its narrow dimensions, while a bedroom could be identified by objects matching the size of a standard mattress or bed frame. This room type determination could be used to weight the effort or amount of cleaning applied to each area of the house prior to establishing a baseline using on-board sensors such as a debris sensing assembly. In some embodiments, a user may be asked to confirm the type of rooms identified by robotic vacuum 1102. In some embodiments, room type can be used to bias a weight of effort exerted by robotic vacuum 1102 even after establishment of the baseline using the on-board sensors.

Once a baseline room type, layout and obstacle identification routine has been carried out, normal cleaning operations can be further refined. A first cleaning operation could include performing at least one pass over all accessible surfaces within residence 1100. Particle detection data collected by a debris sensing assembly can be mapped to various locations during cleaning operations. The rate at which debris passes through the debris sensing assembly can be normalized with historical data indicating how frequently the area is cleaned to arrive at a cleaning priority for each area within residence 1100. For example, even though robotic vacuum 1102 retrieves significant amounts of debris from a particular area, that area could still be assigned a low priority value when that area is very infrequently cleaned. This could be the case where access to the area is limited.

FIG. 11 also shows particular regions of interest within residence 1100. For example, region 1104 could be identified as the region within residence 1100 most likely to collect debris. This could be attributable to crumbs collecting in this region from people frequently dropping bits of food while eating. Region 1106 associated with an entry into residence 1100 could also be an area in which substantial amounts of dirt and debris is tracked into residence 1100 and would need frequent cleaning. Similar to region 1104, region 1108 associated with a food preparation area could also end up collecting various bits of food. These regions identified as being subject to more frequent debris collection could be targeted during additional cleaning operations or during routine cleaning operations. Robotic vacuum could be configured to make multiple cleaning passes when it is expected that additional passes would be necessary to retrieve larger amounts of debris in those regions. In addition to associating the amount of material collected with a particular area, average particle sizes could also be associated with particular regions. In some embodiments, the mode of operation of robotic vacuum 1102 can be adjusted to more efficiently suck up the type of debris most likely to be found in a particular region. A change in the mode of operation can include any number of parameters including but not limited to suction power/blower speed, device speed, roller speed, roller height and tilt angle. Each of these factors can be changed to improve the performance of robotic vacuum 1102 for a particular situation.

Robotic vacuum 1102 could also be configured to identify regions that collect debris very infrequently. For example, region 1110 could be located within a bedroom used primarily for storage. In such a case, debris could collect very slowly within region 1110 allowing robotic vacuum 1102 to skip region 1110 during a majority of scheduled cleaning operations. Alternatively, robotic vacuum 1102 could traverse very quickly over region 1110. A quick traversal of at least a portion of region 1110 can allow a debris collection assembly to monitor buildup of debris within the lower priority region.

While FIG. 11 identifies large regions of residence 1100 that could be more or less susceptible to debris collection, robotic vacuum 1102 is also capable of identifying substantially smaller areas. For example, a particular corner or crevice within residence 1100 could be highly susceptible to debris collection. The route of robotic vacuum 1102 could be adjusted to allow robotic vacuum 1102 to roll over the smaller areas susceptible to large amounts of debris collection. Robotic vacuum 1102 could also generate a debris map using the historical data collected during multiple cleaning operations. The debris map could indicate small segments of each region where debris is expected to be these figures would be updated by new data from each cleaning operation to keep accurate track of most likely locations of debris build up.

Figure 12:
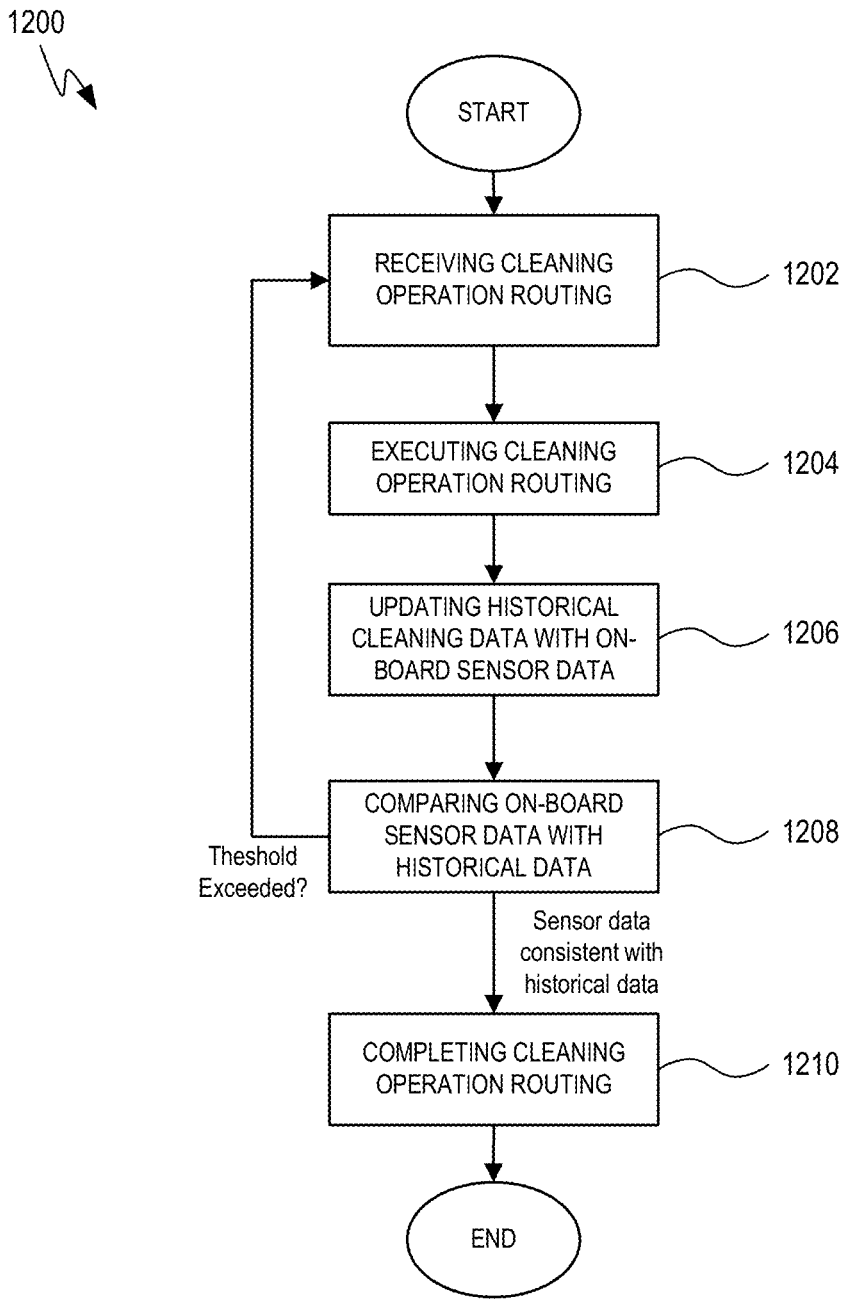
FIG. 12 shows a block diagram illustrating logic that could be followed by a robotic vacuum during a particular cleaning operation.

FIG. 12 shows a block diagram illustrating logic that could be followed by robotic vacuum 1102 during a particular cleaning operation. After start, the robotic vacuum could receive from a remote server or generate internally initial routing instructions at block 1202. The initial routing instructions can be based primarily on information gathered during preceding cleaning and/or previous calibration runs. Various other factors can govern the initial routing instruction provided, including time of day, expected traffic as well as type and duration of most recent cleaning operations. The routing instructions can include specific paths through a residence along which robotic vacuum 1102 is configured to traverse. It should be understood that in certain instances, robotic vacuum 1102 could deviate from the instructions in certain instances for basic obstacle avoidance. At block 1204 robotic vacuum 1102 executes the cleaning operation routing. During the cleaning operation, sensor readings can be recorded to determine whether debris collection is consistent with historical collection figures. The sensors readings can also be used to update the historical cleaning data as shown at block 1206. At block 1208 the data collected during the cleaning operation is compared with the historical debris intake data. When a difference between the sensor data and the historical data exceeds a predetermined threshold the device can be configured to return back to block 1202 where updated cleaning operation routing is received. When, on the other hand, sensor data is consistent with the historical data, robotic vacuum 1102 can proceed with finishing the cleaning operation routing as initially planned.

Figure 13:
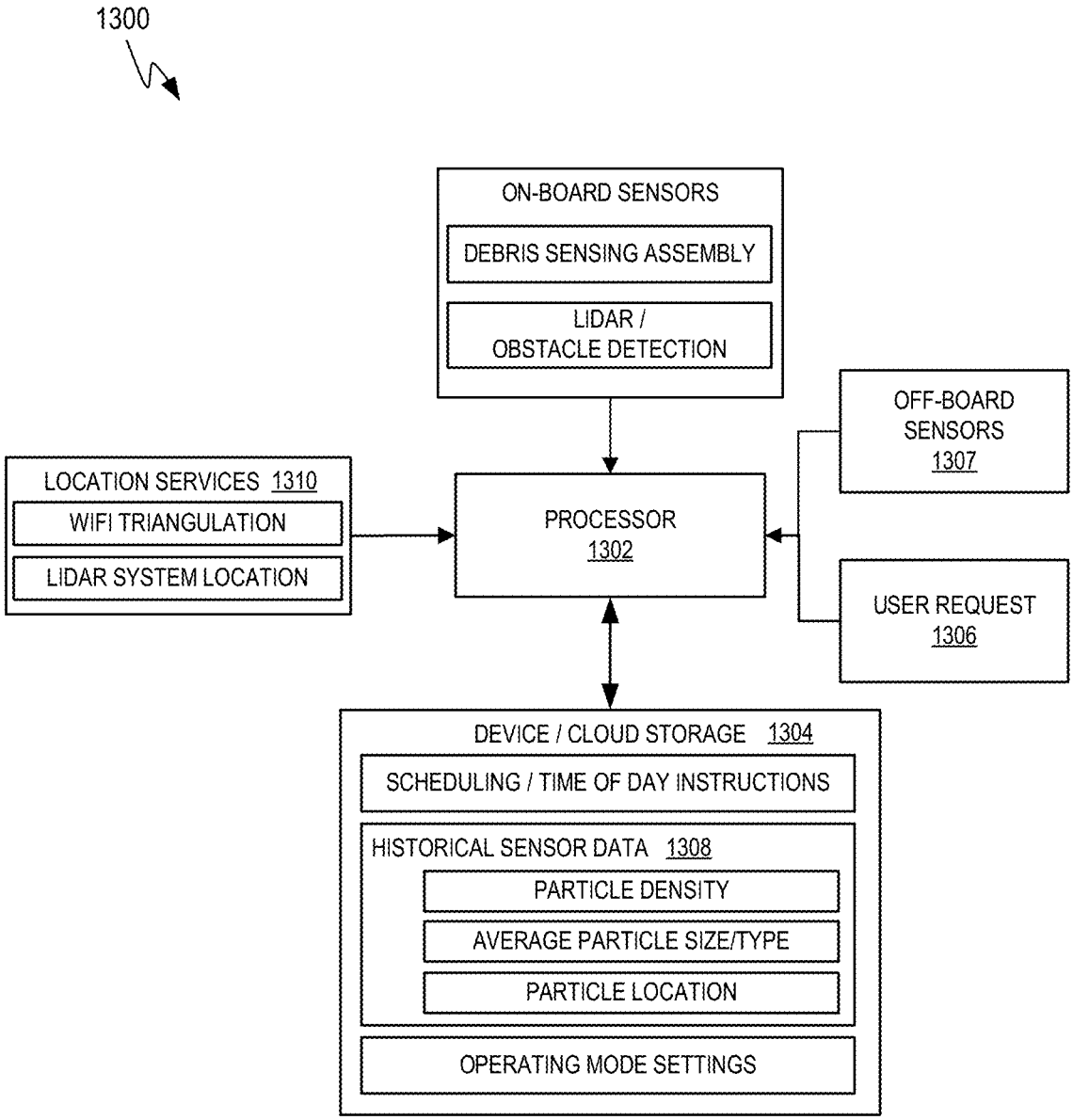
FIG. 13 shows a block diagram illustrating information available to a processing device when creating or updating routing information during or prior to a cleaning operation.

FIG. 13 shows a block diagram illustrating information available to a processing device 1302 when creating or updating routing information during or prior to a cleaning operation performed by a robotic vacuum 1300. Prior to performing a cleaning operation, processor 1302 will rely primarily on device/cloud storage information 1304 but this information may be adjusted or even completely overridden by user requests 1306 and/or cuing from off-board sensors 1307. The number and frequency of cleaning operations can be dictated primarily by a user of the cleaning device. For example, upon initial setup the user can be prompted to identify preferred times for scheduled cleaning operations. The user could choose times where people were less likely to be walking around the house. This scheduling information could therefore be used to initialize the cleaning device prior to a scheduled cleaning operation. Alternatively, off-board sensors 1307 taking the form of one or more security cameras could be used to identify behavior patterns showing particular times of day where operation is unlikely to interfere with activities of the home occupants. The cleaning device could also be manually initialized by user request 1306. For example, the user might notice an area that needs immediate cleanup and instruct the cleaning device to focus on a particular area outside of a normally scheduled cleaning operation. Off-board sensors 1107 could also be used in a similar manner to cue the vacuum to cleanup an area requiring immediate cleanup.

Once robotic vacuum 1300 is initiated for a scheduled, manual or cued cleaning operation, processor 1302 can be configured to begin identifying routing for the cleaning operation. In the case where a user or off-board sensors identify an area to be cleaned, this routing could be as simple as identifying an efficient route to arrive at the area. In some embodiments, the user could indicate a level of effort to make during the impromptu cleaning operation. A user who was familiar with the pickup performance could opt to instruct the cleaning device how many times the cleaning device should cover the identified area. The routing could then be established in a manner that covers the identified area with a number of passes corresponding to the requested level of effort. In some embodiments, an off-board sensor 1307 along the lines of a security camera may be configured to identify the severity of a spill or stained area that occur throughout the day. For example, a pet may knock food off the table at some point during the day. When readings from the security camera identify the spilled food or debris, the information can be relayed to the processing device. When executing one of these manual user driven or off-board sensor cued events, processor 1302 can opt against storing any data picked up by the on-board sensors, as these events can be considered outside normal occurrence.

FIG. 13 shows how historical sensor data 1308 can include many different types of data to help the cleaning device make a determination of how to route and configure various cleaning operations. The first piece of data that can be considered is particle density. Previous sensor readings can indicate average particle density for previous cleaning operations associated with areas of about 4 cm×4 cm in size. Location data can also be tied to larger or smaller areas than the 4 cm×4 cm square. Particle density determinations can be made using readings from the debris sensing assembly. These readings can be correlated with information provided by location services 1310 and normalized using the number of passes and cleaning unit configuration made over any particular location. In some embodiments, location information derived from sources such as WiFi Triangulation and the LIDAR sensor can be accurate enough to identify a 4 cm×4 cm square within which debris was retrieved. In general, the number of planned passes can be established based on historical particle density data. In addition to the number of planned passes, the cleaning device can vary its settings to increase or decrease an efficiency with which particles can be retrieved on any given pass. For example, by slowing the travel of the cleaning device over the floor a larger amount of material can be retrieved. Other possible configuration changes can include brush height, brush speed, blower speed and cleaning device tilt angle. Generally, lower brush height, higher brush speed, higher blower speed and lower tilt angle all generally increase the efficiency of debris pickup. These increases in pickup efficiency generally come at the expense of power output. For example, a lower brush height results in greater contact between the brush and the floor, thereby increasing the power required by the brush motor. Similarly, higher blower speeds require a greater power output. Higher blower speeds increasing suction may also require additional power to be routed to the powered wheels to keep the cleaning device moving at a desired speed. Consequently, all these factors can be considered and compared with available battery power when determining initial routing.

When the historical sensor data also includes average particle size/type, cleaning device configurations can be chosen with much greater accuracy/efficiency. For example, empirical data could show that higher blower speeds are much more helpful than higher brush speeds when particle sizes within a certain range of values are encountered. Consequently, the configuration could be changed in areas where particles within this particular range of particle size are expected. In this way, the cleaning device is able to prioritize which settings to increase to achieve a desired effect. This generally allows cleaning operations to be conducted more efficiently, which allows for a greater amount of debris to be picked up for an available amount of power. In some embodiments, the cleaning device can include a look-up table listing cleaning device configurations for particular particle size ranges. It should be noted that device configuration can be limited by the user. For example, a late night cleaning operation could have a limited audio output. This could result in a sub-optimal cleaning configuration being selected that conforms with the audio output limitations. For example, the cleaning device might need to move more slowly to achieve a reasonable debris pickup efficiency when the audio limitations limit the blower speed.

From time to time actual conditions may be substantially different than originally expected. For example, an unexpected spill or a new guest tracking in large amount of dirt could substantially alter the location and amount of debris in one or more areas of the house. This event or series of events could result in a threshold being exceeded where cleaning operation routing is updated, as described in FIG. 12. Generally, a determination that the threshold was exceeded would not be made immediately but only after a number of readings come back indicating a substantial difference between current sensor readings and sensor readings associated with the current cleaning operation. For example, region 1104 as depicted in FIG. 11 might have substantially more debris than would otherwise be expected due to a dinner party. However, the cleaning device would not instantly recalculate it's cleaning route the first time it picked up some extra crumbs but would instead complete a single pass over a predetermined portion of region 1104 before recalculating the desired route. In some embodiments, the cleaning device could pass over at least 25% of region 1104 before comparing the sensor readings to historical sensor readings. In some embodiments, comparisons between historical and current debris intake readings could be performed only every 5 minutes to provide a large enough amount of data for comparison. Reasons to wait to do a comparison include saving processing power and avoiding re-routing on account of a very small area of increased debris. In this way, re-routing can be carried out only in situations where a clear difference is identified.

D. Computer Systems for Media Platform and Client System

Figure 14:
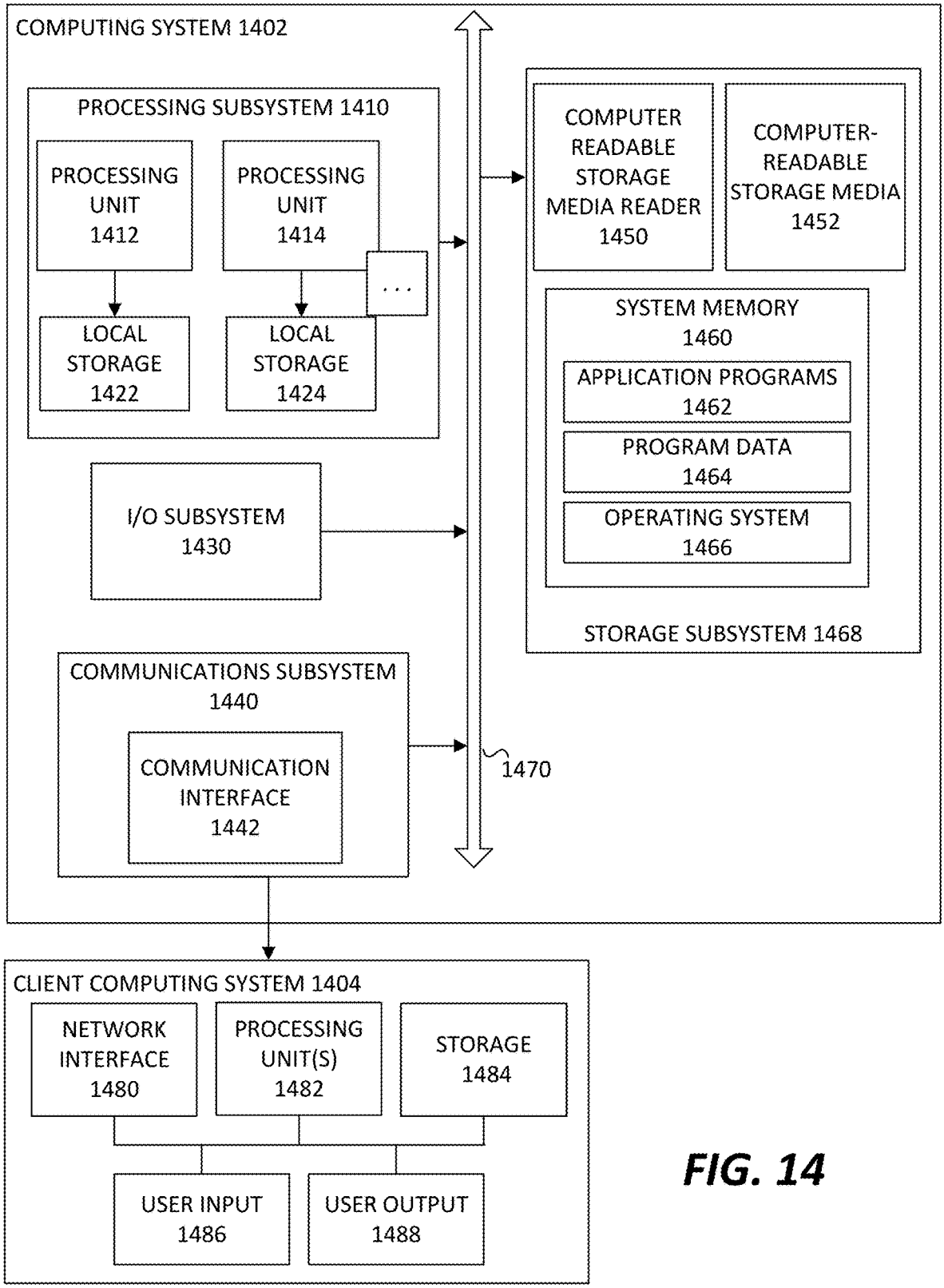
FIG. 14 is a simplified block diagram of a representative computing system and client computing system.

Various operations described herein may be implemented on computer systems. FIG. 14 shows a simplified block diagram of a representative computing system 1402 and client computing system 1404 usable to implement certain embodiments of the present disclosure. In various embodiments, computing system 1402 or similar systems may implement the cleaning robot processor system, remote server, or any other computing system described herein or portions thereof. Client computing system 1404 or similar systems may implement user devices such as a smartphone or watch with a robot cleaner application.

Computing system 1402 may be one of various types, including processor and memory, a handheld portable device (e.g., an iPhone® cellular phone, an iPad® computing tablet, a PDA), a wearable device (e.g., a Google Glass® head mounted display), a personal computer, a workstation, a mainframe, a kiosk, a server rack, or any other data processing system.

Computing system 1402 may include processing subsystem 1410. Processing subsystem 1410 may communicate with a number of peripheral systems via bus subsystem 1470. These peripheral systems may include I/O subsystem 1430, storage subsystem 1468, and communications subsystem 1440.

Bus subsystem 1470 provides a mechanism for letting the various components and subsystems of server computing system 1404 communicate with each other as intended. Although bus subsystem 1470 is shown schematically as a single bus, alternative embodiments of the bus subsystem may utilize multiple buses. Bus subsystem 1470 may form a local area network that supports communication in processing subsystem 1410 and other components of server computing system 1402. Bus subsystem 1470 may be implemented using various technologies including server racks, hubs, routers, etc. Bus subsystem 1470 may be any of several types of bus structures including a memory bus or memory controller, a peripheral bus, and a local bus using any of a variety of bus architectures. For example, such architectures may include an Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus, which may be implemented as a Mezzanine bus manufactured to the IEEE P1386.1 standard, and the like.

I/O subsystem 1430 may include devices and mechanisms for inputting information to computing system 1402 and/or for outputting information from or via computing system 1402. In general, use of the term "input device" is intended to include all possible types of devices and mechanisms for inputting information to computing system 1402. User interface input devices may include, for example, a keyboard, pointing devices such as a mouse or trackball, a touchpad or touch screen incorporated into a display, a scroll wheel, a click wheel, a dial, a button, a switch, a keypad, audio input devices with voice command recognition systems, microphones, and other types of input devices. User interface input devices may also include motion sensing and/or gesture recognition devices such as the Microsoft Kinect® motion sensor that enables users to control and interact with an input device, the Microsoft Xbox® 360 game controller, devices that provide an interface for receiving input using gestures and spoken commands. User interface input devices may also include eye gesture recognition devices such as the Google Glass® blink detector that detects eye activity (e.g., "blinking" while taking pictures and/or making a menu selection) from users and transforms the eye gestures as input into an input device (e.g., Google Glass®). Additionally, user interface input devices may include voice recognition sensing devices that enable users to interact with voice recognition systems (e.g., Siri® navigator), through voice commands.

Other examples of user interface input devices include, without limitation, three dimensional (3D) mice, joysticks or pointing sticks, gamepads and graphic tablets, and audio/visual devices such as speakers, digital cameras, digital camcorders, portable media players, webcams, image scanners, fingerprint scanners, barcode reader 3D scanners, 3D printers, laser rangefinders, and eye gaze tracking devices. Additionally, user interface input devices may include, for example, medical imaging input devices such as computed tomography, magnetic resonance imaging, position emission tomography, medical ultrasonography devices. User interface input devices may also include, for example, audio input devices such as MIDI keyboards, digital musical instruments and the like.

User interface output devices may include a display subsystem, indicator lights, or non-visual displays such as audio output devices, etc. The display subsystem may be a cathode ray tube (CRT), a flat-panel device, such as that using a liquid crystal display (LCD) or plasma display, a projection device, a touch screen, and the like. In general, use of the term "output device" is intended to include all possible types of devices and mechanisms for outputting information from computing system 1402 to a user or other computer. For example, user interface output devices may include, without limitation, a variety of display devices that visually convey text, graphics and audio/video information such as monitors, printers, speakers, headphones, automotive navigation systems, plotters, voice output devices, and modems.

Processing subsystem 1410 controls the operation of computing system 1402 and may comprise one or more processing units 1412, 1414, etc. A processing unit may include one or more processors, including single core processor or multicore processors, one or more cores of processors, or combinations thereof. In some embodiments, processing subsystem 1410 may include one or more special purpose co-processors such as graphics processors, digital signal processors (DSPs), or the like. In some embodiments, some or all of the processing units of processing subsystem 1410 may be implemented using customized circuits, such as application specific integrated circuits (ASICs), or field programmable gate arrays (FPGAs). In some embodiments, such integrated circuits execute instructions that are stored on the circuit itself. In other embodiments, processing unit(s) may execute instructions stored in local storage, e.g., local storage 1422, 1424. Any type of processors in any combination may be included in processing unit(s) 1412, 1414.

In some embodiments, processing subsystem 1410 may be implemented in a modular design that incorporates any number of modules (e.g., blades in a blade server implementation). Each module may include processing unit(s) and local storage. For example, processing subsystem 1410 may include processing unit 1412 and corresponding local storage 1422, and processing unit 1414 and corresponding local storage 1424.

Local storage 1422, 1424 may include volatile storage media (e.g., conventional DRAM, SRAM, SDRAM, or the like) and/or non-volatile storage media (e.g., magnetic or optical disk, flash memory, or the like). Storage media incorporated in local storage 1422, 1424 may be fixed, removable or upgradeable as desired. Local storage 1422, 1424 may be physically or logically divided into various subunits such as a system memory, a ROM, and a permanent storage device. The system memory may be a read-and-write memory device or a volatile read-and-write memory, such as dynamic random access memory. The system memory may store some or all of the instructions and data that processing unit(s) 1412, 1414 need at runtime. The ROM may store static data and instructions that are needed by processing unit(s) 1412, 1414. The permanent storage device may be a non-volatile read-and-write memory device that may store instructions and data even when a module including one or more processing units 1412, 1414 and local storage 1422, 1424 is powered down. The term "storage medium" as used herein includes any medium in which data may be stored indefinitely (subject to overwriting, electrical disturbance, power loss, or the like) and does not include carrier waves and transitory electronic signals propagating wirelessly or over wired connections.

In some embodiments, local storage 1422, 1424 may store one or more software programs to be executed by processing unit(s) 1412, 1414, such as an operating system and/or programs implementing various server functions such as functions of described above. "Software" refers generally to sequences of instructions that, when executed by processing unit(s) 1412, 1414 cause computing system 1402 (or portions thereof) to perform various operations, thus defining one or more specific machine implementations that execute and perform the operations of the software programs. The instructions may be stored as firmware residing in read-only memory and/or program code stored in non-volatile storage media that may be read into volatile working memory for execution by processing unit(s) 1412, 1414. In some embodiments the instructions may be stored by storage subsystem 1468 (e.g., computer readable storage media). In various embodiments, the processing units may execute a variety of programs or code instructions and may maintain multiple concurrently executing programs or processes. At any given time, some or all of the program code to be executed may be resident in local storage 1422, 1424 and/or in storage subsystem including potentially on one or more storage devices. Software may be implemented as a single program or a collection of separate programs or program modules that interact as desired. From local storage 1422, 1424 (or non-local storage described below), processing unit(s) 1412, 1414 may retrieve program instructions to execute and data to process in order to execute various operations described above.

Storage subsystem 1468 provides a repository or data store for storing information that is used by computing system 1402. Storage subsystem 1468 provides a tangible non-transitory computer-readable storage medium for storing the basic programming and data constructs that provide the functionality of some embodiments. Software (programs, code modules, instructions) that when executed by processing subsystem 1410 provide the functionality described above may be stored in storage subsystem 1468. The software may be executed by one or more processing units of processing subsystem 1410. Storage subsystem 1468 may also provide a repository for storing data used in accordance with the present disclosure.

Storage subsystem 1468 may include one or more non-transitory memory devices, including volatile and non-volatile memory devices. As shown in FIG. 14, storage subsystem 1468 includes a system memory 1460 and a computer-readable storage media 1452. System memory 1460 may include a number of memories including a volatile main RAM for storage of instructions and data during program execution and a non-volatile ROM or flash memory in which fixed instructions are stored. In some implementations, a basic input/output system (BIOS), containing the basic routines that help to transfer information between elements within computing system 1402, such as during start-up, may typically be stored in the ROM. The RAM typically contains data and/or program modules that are presently being operated and executed by processing subsystem 1410. In some implementations, system memory 1460 may include multiple different types of memory, such as static random access memory (SRAM) or dynamic random access memory (DRAM). Storage subsystem 1468 may be based on magnetic, optical, semiconductor, or other data storage media. Direct attached storage, storage area networks, network-attached storage, and the like may be used. Any data stores or other collections of data described herein as being produced, consumed, or maintained by a service or server may be stored in storage subsystem 1468.

By way of example, and not limitation, as depicted in FIG. 14, system memory 1460 may store application programs 1462, which may include client applications, Web browsers, mid-tier applications, relational database management systems (RDBMS), etc., program data 1464, and one or more operating systems 1466. By way of example, an example operating systems may include various versions of Microsoft Windows®, Apple Macintosh®, and/or Linux operating systems, a variety of commercially-available UNIX® or UNIX-like operating systems (including without limitation the variety of GNU/Linux operating systems, the Google Chrome® OS, and the like) and/or mobile operating systems such as iOS, Windows® Phone, Android® OS, BlackBerry® 10 OS, and Palm® OS operating systems.

Computer-readable storage media 1452 may store programming and data constructs that provide the functionality of some embodiments. Software (programs, code modules, instructions) that when executed by processing subsystem 1410 a processor provide the functionality described above may be stored in storage subsystem 1468. By way of example, computer-readable storage media 1452 may include non-volatile memory such as a hard disk drive, a magnetic disk drive, an optical disk drive such as a CD ROM, DVD, a Blu-Ray® disk, or other optical media. Computer-readable storage media 1452 may include, but is not limited to, Zip® drives, flash memory cards, universal serial bus (USB) flash drives, secure digital (SD) cards, DVD disks, digital video tape, and the like. Computer-readable storage media 1452 may also include, solid-state drives (SSD) based on non-volatile memory such as flash-memory based SSDs, enterprise flash drives, solid state ROM, and the like, SSDs based on volatile memory such as solid state RAM, dynamic RAM, static RAM, DRAM-based SSDs, magnetoresistive RAM (MRAM) SSDs, and hybrid SSDs that use a combination of DRAM and flash memory based SSDs. Computer-readable media 1452 may provide storage of computer-readable instructions, data structures, program modules, and other data for computing system 1402.

In certain embodiments, storage subsystem 1468 may also include a computer-readable storage media reader 1450 that may further be connected to computer-readable storage media 1452. Together and, optionally, in combination with system memory 1460, computer-readable storage media 1452 may comprehensively represent remote, local, fixed, and/or removable storage devices plus storage media for storing computer-readable information.

In certain embodiments, computing system 1402 may provide support for executing one or more virtual machines. Computing system 1402 may execute a program such as a hypervisor for facilitating the configuring and managing of the virtual machines. Each virtual machine may be allocated memory, compute (e.g., processors, cores), I/O, and networking resources. Each virtual machine typically runs its own operating system, which may be the same as or different from the operating systems executed by other virtual machines executed by computing system 1402. Accordingly, multiple operating systems may potentially be run concurrently by computing system 1402. Each virtual machine generally runs independently of the other virtual machines.

Communication subsystem 1440 provides an interface to other computer systems and networks. Communication subsystem 1440 serves as an interface for receiving data from and transmitting data to other systems from computing system 1402. For example, communication subsystem 1440 may enable computing system 1402 to establish a communication channel to one or more client computing devices via the Internet for receiving and sending information from and to the client computing devices.

Communication subsystem 1440 may support both wired and/or wireless communication protocols. For example, in certain embodiments, communication subsystem 1440 may include radio frequency (RF) transceiver components for accessing wireless voice and/or data networks (e.g., using cellular telephone technology, advanced data network technology, such as 3G, 4G or EDGE (enhanced data rates for global evolution), WiFi (IEEE 802.11 family standards, or other mobile communication technologies, or any combination thereof), global positioning system (GPS) receiver components, and/or other components. In some embodiments communication subsystem 1440 may provide wired network connectivity (e.g., Ethernet) in addition to or instead of a wireless interface.

Communication subsystem 1440 may receive and transmit data in various forms. For example, in some embodiments, communication subsystem 1440 may receive input communication in the form of structured and/or unstructured data feeds, event streams, event updates, and the like. For example, communication subsystem 1440 may be configured to receive (or send) data feeds in real-time from users of social media networks and/or other communication services such as Twitter® feeds, Facebook® updates, web feeds such as Rich Site Summary (RSS) feeds, and/or real-time updates from one or more third party information sources.

In certain embodiments, communication subsystem 1440 may be configured to receive data in the form of continuous data streams, which may include event streams of real-time events and/or event updates, that may be continuous or unbounded in nature with no explicit end. Examples of applications that generate continuous data may include, for example, sensor data applications, financial tickers, network performance measuring tools (e.g. network monitoring and traffic management applications), clickstream analysis tools, automobile traffic monitoring, and the like.

Communication subsystem 1440 may also be configured to output the structured and/or unstructured data feeds, event streams, event updates, and the like to one or more databases that may be in communication with one or more streaming data source computers coupled to computing system 1402.

Communication subsystem 1440 may provide a communication interface 1442, e.g., a WAN interface, which may provide data communication capability between the local area network (bus subsystem 1470) and a larger network, such as the Internet. Conventional or other communications technologies may be used, including wired (e.g., Ethernet, IEEE 802.3 standards) and/or wireless technologies (e.g., WiFi, IEEE 802.11 standards).

Computing system 1402 may operate in response to requests received via communication interface 1442. Further, in some embodiments, communication interface 1442 may connect computing systems 1402 to each other, providing scalable systems capable of managing high volumes of activity. Conventional or other techniques for managing server systems and server farms (collections of server systems that cooperate) may be used, including dynamic resource allocation and reallocation.

Computing system 1402 may interact with various user-owned or user-operated devices via a wide-area network such as the Internet. An example of a user-operated device is shown in FIG. 14 as client computing system 1402. Client computing system 1404 may be implemented, for example, as a consumer device such as a smart phone, other mobile phone, tablet computer, wearable computing device (e.g., smart watch, eyeglasses), desktop computer, laptop computer, and so on.

For example, client computing system 1404 may communicate with computing system 1402 via communication interface 1442. Client computing system 1404 may include conventional computer components such as processing unit(s) 1482, storage device 1484, network interface 1480, user input device 1486, and user output device 1488. Client computing system 1404 may be a computing device implemented in a variety of form factors, such as a desktop computer, laptop computer, tablet computer, smart phone, other mobile computing device, wearable computing device, or the like.

Processing unit(s) 1482 and storage device 1484 may be similar to processing unit(s) 1412, 1414 and local storage 1422, 1424 described above. Suitable devices may be selected based on the demands to be placed on client computing system 1404; for example, client computing system 1404 may be implemented as a "thin" client with limited processing capability or as a high-powered computing device. Client computing system 1404 may be provisioned with program code executable by processing unit(s) 1482 to enable various interactions with computing system 1402 of a message management service such as accessing messages, performing actions on messages, and other interactions described above. Some client computing systems 1404 may also interact with a messaging service independently of the message management service.

Network interface 1480 may provide a connection to a wide area network (e.g., the Internet) to which communication interface 1440 of computing system 1402 is also connected. In various embodiments, network interface 1480 may include a wired interface (e.g., Ethernet) and/or a wireless interface implementing various RF data communication standards such as WiFi, Bluetooth, or cellular data network standards (e.g., 3G, 4G, LTE, etc.).

User input device 1486 may include any device (or devices) via which a user may provide signals to client computing system 1404; client computing system 1404 may interpret the signals as indicative of particular user requests or information. In various embodiments, user input device 1486 may include any or all of a keyboard, touch pad, touch screen, mouse or other pointing device, scroll wheel, click wheel, dial, button, switch, keypad, microphone, and so on.

User output device 1488 may include any device via which client computing system 1404 may provide information to a user. For example, user output device 1488 may include a display to display images generated by or delivered to client computing system 1404. The display may incorporate various image generation technologies, e.g., a liquid crystal display (LCD), light-emitting diode (LED) including organic light-emitting diodes (OLED), projection system, cathode ray tube (CRT), or the like, together with supporting electronics (e.g., digital-to-analog or analog-to-digital converters, signal processors, or the like). Some embodiments may include a device such as a touchscreen that function as both input and output device. In some embodiments, other user output devices 1488 may be provided in addition to or instead of a display. Examples include indicator lights, speakers, tactile "display" devices, printers, and so on.

Some embodiments include electronic components, such as microprocessors, storage and memory that store computer program instructions in a computer readable storage medium. Many of the features described in this specification may be implemented as processes that are specified as a set of program instructions encoded on a computer readable storage medium. When these program instructions are executed by one or more processing units, they cause the processing unit(s) to perform various operation indicated in the program instructions. Examples of program instructions or computer code include machine code, such as is produced by a compiler, and files including higher-level code that are executed by a computer, an electronic component, or a microprocessor using an interpreter. Through suitable programming, processing unit(s) 1412, 1414 and 1482 may provide various functionality for computing system 1402 and client computing system 1404, including any of the functionality described herein as being performed by a server or client, or other functionality associated with message management services.

It will be appreciated that computing system 1402 and client computing system 1404 are illustrative and that variations and modifications are possible. Computer systems used in connection with embodiments of the present disclosure may have other capabilities not specifically described here. Further, while computing system 1402 and client computing system 1404 are described with reference to particular blocks, it is to be understood that these blocks are defined for convenience of description and are not intended to imply a particular physical arrangement of component parts. For instance, different blocks may be but need not be located in the same facility, in the same server rack, or on the same motherboard. Further, the blocks need not correspond to physically distinct components. Blocks may be configured to perform various operations, e.g., by programming a processor or providing appropriate control circuitry, and various blocks might or might not be reconfigurable depending on how the initial configuration is obtained. Embodiments of the present disclosure may be realized in a variety of apparatus including electronic devices implemented using any combination of circuitry and software.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A robotic cleaning device, comprising:

a housing having walls defining a conduit extending from an air intake to a receptacle for retaining particles drawn through the conduit;

a suction system for drawing air through the air intake, along the conduit and into the receptacle;

a light emitter configured to emit light across the conduit and out of the conduit through an opening defined by the one of the walls of the housing;

a light detector proximate the light emitter and coupled to a portion of one of the walls defining the conduit, the light detector being configured to detect a portion of the light that is scattered by particles being drawn through the conduit; and a processor configured to receive sensor data from the light detector and to determine how many particles are passing through the conduit based on variations in the sensor data;

wherein the light emitter comprises a first laser and a second laser.

2. The robotic cleaning device as recited in claim 1, wherein the first laser is downstream of the second laser.

3. The robotic cleaning device as recited in claim 2, wherein the first laser emits light having a different wavelength than the light emitted by the second laser.

4. The robotic cleaning device as recited in claim 2, wherein a distance between the first and second lasers and time elapsed between particles scattering light from the first and second lasers is used by the processor to determine a velocity of particles passing through the conduit.

5. A robotic cleaning device, comprising:

a housing having walls defining a conduit extending from an air intake to a receptacle for retaining particles drawn through the conduit;

a suction system for drawing air through the air intake, along the conduit and into the receptacle;

a light emitter configured to emit light across the conduit and out of the conduit through an opening defined by the one of the walls of the housing;

a light detector proximate the light emitter and coupled to a portion of one of the walls defining the conduit, the light detector being configured to detect a portion of the light that is scattered by particles being drawn through the conduit; and a processor configured to receive sensor data from the light detector and to determine how many particles are passing through the conduit based on variations in the sensor data; and a beam stop sensor positioned outside of the conduit and aligned with the opening, the beam stop sensor being configured to receive light travelling directly from the light emitter to the beam stop sensor.

6. The robotic cleaning device as recited in claim 5 wherein light is a light beam and the opening for the beam stop sensor is wider than the light beam to avoid reflections.

7. A robotic cleaning device, comprising:

a housing having walls defining a conduit extending from an air intake to a receptacle for retaining particles drawn through the conduit;

a suction system for drawing air through the air intake, along the conduit and into the receptacle;

a light emitter configured to emit light across the conduit and out of the conduit through an opening defined by the one of the walls of the housing;

a light detector proximate the light emitter and coupled to a portion of one of the walls defining the conduit, the light detector being configured to detect a portion of the light that is scattered by particles being drawn through the conduit; and a processor configured to receive sensor data from the light detector and to determine how many particles are passing through the conduit based on variations in the sensor data;

wherein the processor utilizes a Mie scattering model to determine a diameter of a particle scattering light emitted by the light emitter.

8. The robotic cleaning device as recited in claim 7, further comprising at least a second light detector coupled to a portion of one of the walls defining the conduit, positioned so that the light beam does not shine directly on the second light detector, the second light detector being configured to detect a portion of the light that is scattered by particles being drawn through the conduit.

9. The robotic cleaning device as recited in claim 8 wherein the processor is configured to compare readings from the first mentioned and second light detectors.

10. The robotic cleaning device as recited in claim 7 wherein the light beam is collimated.

11. The robotic cleaning device as recited in claim 7, wherein the light beam is infrared.

12. A robotic cleaning device, comprising:

a housing having walls defining a conduit extending from an air intake to a receptacle for retaining particles drawn through the conduit, wherein an interior surface of the conduit has light absorbing characteristics;

a suction system for drawing air through the air intake, along the conduit and into the receptacle;

an infrared light emitter configured to emit a collimated light beam across the conduit and out of the conduit through an opening defined by the one of the walls of the housing;

a plurality of light detectors coupled to a portion of one of the walls defining the conduit, positioned so that the collimated light beam does not shine directly on the light detectors, the light detectors being configured to detect a portion of the light that is scattered by particles being drawn through the conduit; and a processor configured to receive sensor data from the light detector and to determine how many particles are passing through the conduit based on variations in the sensor data;

wherein the processor utilizes a scattering model to determine a diameter of a particle scattering light emitted by the infrared light emitter, the scattering model being one of geometric scattering, mie scattering, non-spherical particles method and Rayleigh scattering.

13. The robotic cleaning device as recited in claim 12, further comprising:

a sensor configured to provide sensor readings that identify walls and obstructions in order to help the processor route the robotic cleaning device around obstacles and through different rooms during a cleaning operation.

14. The robotic cleaning device as recited in claim 12, further comprising computer readable memory having historical particle location data detailing how much debris was picked up from particular areas of a residence during multiple previous cleaning operations.

15. The robotic cleaning device as recited in claim 12, wherein the air intake is a first air intake and the robotic cleaning device further comprises a second air intake and a rotary brush arranged at the first air intake.

16. The robotic cleaning device as recited in claim 12 wherein an interior surface of the conduit has light absorbing characteristics.

17. The robotic cleaning device as recited in claim 12, further comprising:

a second conduit, smaller than the first mentioned conduit, and wherein the light emitter is in the first mentioned conduit.

* * * * *